US010295949B2

(12) United States Patent
Kato

(10) Patent No.: US 10,295,949 B2
(45) Date of Patent: May 21, 2019

(54) CLEANING BLADE AND IMAGE FORMING APPARATUS

(71) Applicant: Oki Data Corporation, Tokyo (JP)

(72) Inventor: Ken Kato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/885,877

(22) Filed: Feb. 1, 2018

(65) Prior Publication Data

US 2018/0157207 A1 Jun. 7, 2018

Related U.S. Application Data

(62) Division of application No. 15/068,930, filed on Mar. 14, 2016.

(30) Foreign Application Priority Data

Apr. 28, 2015 (JP) ..... 2015-091792

(51) Int. Cl.
*G03G 21/00* (2006.01)

(52) U.S. Cl.
CPC ..... *G03G 21/0017* (2013.01)

(58) Field of Classification Search
CPC ..... G03G 21/0017
See application file for complete search history.

(56) References Cited

U.S. PATENT DOCUMENTS 6,128,462 A 10/2000 Kato et al.
6,519,536 B1 2/2003 Brunacci et al.
7,769,337 B2 * 8/2010 Itoh ..... G03G 9/0819 399/350
7,796,934 B2 * 9/2010 Teshigawara ..... G03G 21/0017 399/302
2009/0111045 A1 * 4/2009 Oyama ..... G03G 9/0804 430/137.14
2009/0226229 A1 9/2009 Tsunoda
2010/0232850 A1 * 9/2010 Koido ..... G03G 21/0058 399/357

(Continued)

FOREIGN PATENT DOCUMENTS

JP 2000056659 A 2/2000
JP 2006171546 A 6/2006
JP 2006301273 A 11/2006

(Continued)

OTHER PUBLICATIONS

Office Action dated Jan. 3, 2017 in U.S. Appl. No. 15/068,930, by Kato.

(Continued)

*Primary Examiner* — Walter L Lindsay, Jr.
*Assistant Examiner* — Arlene Heredia
(74) *Attorney, Agent, or Firm* — Panitch Schwarze Belisario & Nadel LLP

(57) ABSTRACT

A cleaning blade has a contact portion contacting a surface of an image bearing body. The contact portion removes a developer remaining on the surface of the image bearing body when the image bearing body rotates. Using coefficients α and β and a temperature T, a loss elastic modulus E" of the cleaning blade is represented by:

$$E''=\alpha\times e^{\beta T};$$

$$1.36\times10^{3}\leq\alpha\leq2.24\times10^{9};$$

$$-0.12\leq\beta\leq-0.005;\text{ and}$$

$$0^\circ\text{ C.}\leq T\leq100^\circ\text{ C.}$$

20 Claims, 12 Drawing Sheets

(56) References Cited

U.S. PATENT DOCUMENTS

2010/0316412 A1 12/2010 Mitsumori et al.

FOREIGN PATENT DOCUMENTS

JP 2007293319 A 11/2007
JP 2009210958 A 9/2009

OTHER PUBLICATIONS

Office Action dated Nov. 2, 2017 in U.S. Appl. No. 15/068,930, by Kato.
Office Action dated Jun. 5, 2017 in U.S. Appl. No. 15/068,930, by Kato.

* cited by examiner

| $\beta$ \ $\alpha$ | $2.24 \times 10^9$ [Pa] | $1.95 \times 10^9$ [Pa] | $5.31 \times 10^7$ [Pa] | $1.36 \times 10^6$ [Pa] |
|---|---|---|---|---|
| -0.2 | × | × | × | × |
| -0.15 | × | × | × | × |
| -0.12 | ○ | ○ | ○ | ○ |
| -0.096 | ○ | ○ | ○ | ○ |
| -0.083 | ◎ | ◎ | ◎ | ◎ |
| -0.024 | ◎ | ◎ | ◎ | ◎ |
| -0.005 | ◎ | ◎ | ◎ | ◎ |

$\gamma = 1.70 \times 10^4$

| $\beta$ \ $\alpha$ | $2.24 \times 10^9$ | $1.95 \times 10^9$ | $5.31 \times 10^7$ | $1.36 \times 10^6$ |
|---|---|---|---|---|
| -0.2 | × | × | × | × |
| -0.15 | × | × | × | × |
| -0.12 | ○ | ○ | ○ | ○ |
| -0.096 | ○ | ○ | ○ | ○ |
| -0.083 | ◎ | ◎ | ◎ | ◎ |
| -0.024 | ◎ | ◎ | ◎ | ◎ |
| -0.005 | ◎ | ◎ | ◎ | ◎ |

$\gamma = 2.52 \times 10^4$

| $\beta$ \ $\alpha$ | $2.24 \times 10^9$ | $1.95 \times 10^9$ | $5.31 \times 10^7$ | $1.36 \times 10^6$ |
|---|---|---|---|---|
| -0.2 | × | × | × | × |
| -0.15 | × | × | × | × |
| -0.12 | ◎ | ◎ | ◎ | ◎ |
| -0.096 | ◎ | ◎ | ◎ | ◎ |
| -0.083 | ◎ | ◎ | ◎ | ◎ |
| -0.024 | ◎ | ◎ | ◎ | ◎ |
| -0.005 | ◎ | ◎ | ◎ | ◎ |

$\gamma = 3.00 \times 10^4$

| $\beta$ \ $\alpha$ | $2.24 \times 10^9$ | $1.95 \times 10^9$ | $5.31 \times 10^7$ | $1.36 \times 10^6$ |
|---|---|---|---|---|
| -0.2 | × | × | × | × |
| -0.15 | × | × | × | × |
| -0.12 | ◎ | ◎ | ◎ | ◎ |
| -0.096 | ◎ | ◎ | ◎ | ◎ |
| -0.083 | ◎ | ◎ | ◎ | ◎ |
| -0.024 | ◎ | ◎ | ◎ | ◎ |
| -0.005 | ◎ | ◎ | ◎ | ◎ |

$\gamma = 6.84 \times 10^4$

| $\beta$ \ $\alpha$ | $2.24 \times 10^9$ | $1.95 \times 10^9$ | $5.31 \times 10^7$ | $1.36 \times 10^6$ |
|---|---|---|---|---|
| -0.2 | × | × | × | × |
| -0.15 | × | × | × | × |
| -0.12 | ◎ | ◎ | ◎ | ◎ |
| -0.096 | ◎ | ◎ | ◎ | ◎ |
| -0.083 | ◎ | ◎ | ◎ | ◎ |
| -0.024 | ◎ | ◎ | ◎ | ◎ |
| -0.005 | ◎ | ◎ | ◎ | ◎ |

$\gamma = 2.61 \times 10^5$

| $\beta$ \ $\alpha$ | $2.24 \times 10^9$ | $1.95 \times 10^9$ | $5.31 \times 10^7$ | $1.36 \times 10^6$ |
|---|---|---|---|---|
| -0.2 | × | × | × | × |
| -0.15 | × | × | × | × |
| -0.12 | ◎ | ◎ | ◎ | ◎ |
| -0.096 | ◎ | ◎ | ◎ | ◎ |
| -0.083 | ◎ | ◎ | ◎ | ◎ |
| -0.024 | ◎ | ◎ | ◎ | ◎ |
| -0.005 | ◎ | ◎ | ◎ | ◎ |

CLEANING BLADE AND IMAGE FORMING APPARATUS

CROSS-REFERENCE TO RELATED APPLICATION

This application is a Divisional of U.S. patent application Ser. No. 15/068,930, filed Mar. 14, 2016, which claims priority under 35 U.S.C. § 119(b) to Japanese Patent Application No. 2015-091792, filed Apr. 28, 2015, the disclosures of which are incorporated herein by reference in their entirety.

BACKGROUND OF THE INVENTION

The present invention relates to an image forming apparatus using electrophotography, and a cleaning blade provided in the image forming apparatus.

In a general electrophotographic image forming apparatus, a surface of a photosensitive drum as an image bearing body (or an electrostatic latent image bearing body) is uniformly charged by a charging roller. Then, the surface of the photosensitive drum is exposed with light emitted by an electrostatic latent image writing device such as an LED head, and an electrostatic latent image is formed. The electrostatic latent image on the photosensitive drum surface is developed with a toner by, for example, a developing roller as a developer bearing body, and a toner image as a developer image is formed on the photosensitive drum. The toner image is transferred to a sheet as a medium by, for example, a transfer roller as a transfer member. The toner and external additives thereof which are not transferred to the sheet and remain on the photosensitive drum are removed by a cleaning member. Recently, in order to enhance image quality (i.e., image definition) and to increase printing speed, a toner having a small particle diameter and a low melting point has come into use. Further, in order to maintain cleaning performance of the cleaning member, it has been proposed to specify a loss elastic modulus of a cleaning blade as the cleaning member (see, Japanese Laid Open Patent Publication No. 2006-171546).

However, even when the loss elastic modulus of the cleaning member is specified, there may be cases where the external additives or the like of the toner may pass through the cleaning blade, depending on a use environment temperature. In such a case, excellent image quality cannot be obtained.

SUMMARY OF THE INVENTION

An aspect of the present invention is intended to provide a cleaning blade and an image forming apparatus capable of reducing a passing-through of a developer and external additives through a cleaning blade, and capable of obtaining excellent image quality.

According to an aspect of the present invention, there is provided a cleaning blade having a contact portion contacting a surface of an image bearing body. The contact portion removes a developer remaining on the surface of the image bearing body when the image bearing body rotates. Using coefficients α and β and a temperature T, a loss elastic modulus E" of the cleaning blade is represented by:

$$E''=\alpha\times e^{\beta T};$$

$$1.36\times10^{3}\leq\alpha\leq2.24\times10^{9};$$

$$-0.12\leq\beta\leq-0.005;\text{ and}$$

$$0^\circ\text{ C.}\leq T\leq100^\circ\text{ C.}$$

According to another aspect of the present invention, there is provided a cleaning blade having a contact portion contacting a surface of an image bearing body. The contact portion removes a developer remaining on the surface of the image bearing body when the image bearing body rotates. Using coefficients α, β and γ and a temperature T, a loss elastic modulus E" of the cleaning blade is represented by:

$$E''=\alpha\times e^{\beta T}+\gamma;$$

$$1.36\times10^{3}\leq\alpha\leq2.24\times10^{9};$$

$$-0.12\leq\beta\leq-0.005;$$

$$1.70\times10^{4}\leq\gamma\leq2.61\times10^{5};\text{ and}$$

$$0^\circ\text{ C.}\leq T\leq100^\circ\text{ C.}$$

According to still another aspect of the present invention, there is provided an image forming apparatus including the cleaning blade and the image bearing body which the contact portion of the cleaning blade contacts.

With such a configuration, it becomes possible to provide a cleaning blade and an image forming apparatus capable of reducing a passing-through of a developer and external additives through a cleaning blade, and capable of obtaining excellent image quality.

DETAILED DESCRIPTION OF THE PREFERRED EMBODIMENT

Embodiment 1

<Configuration of Image Forming Apparatus 100>

Figure 1:
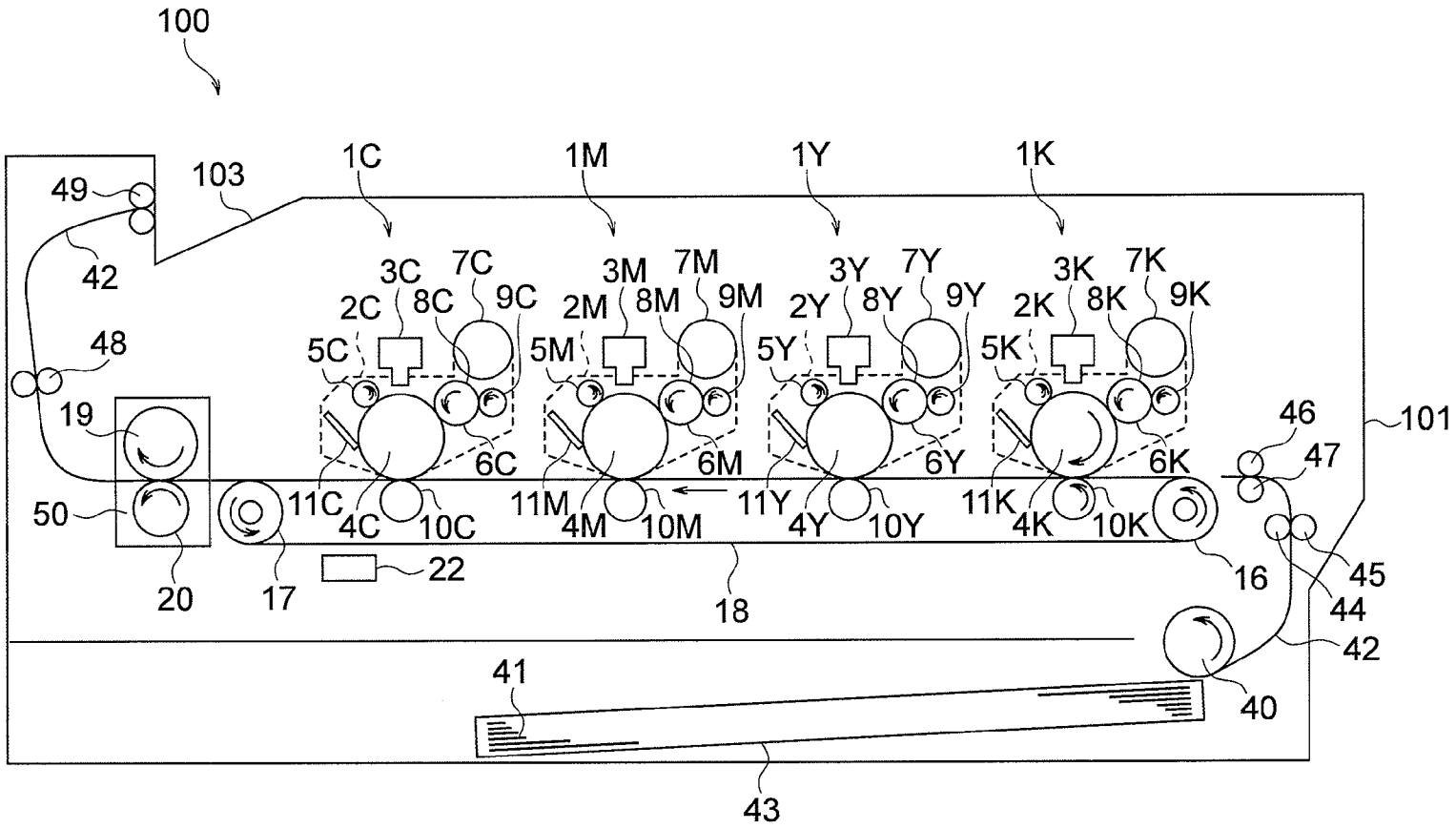
FIG. 1 is a sectional view illustrating a configuration of an image forming apparatus according Embodiment 1 of the present invention.

FIG. 1 is a sectional view illustrating a configuration of an image forming apparatus 100 according to Embodiment 1. The image forming apparatus 100 is, for example, a printer configured to form a color image using electrophotography.

The image forming apparatus 100 includes a housing 101 and image forming units 1K, 1Y, 1M and 1C respectively configured to form images of black, yellow, magenta and cyan.

The image forming apparatus 100 further includes transfer rollers 10K, 10Y, 10M and 10C as transfer members configured to transfer images formed by the image forming units 1K, 1Y, 1M and 1C to a recording medium 41 such as a printing sheet. The image forming apparatus 100 further includes an endless transport belt 18 configured to hold and transport the recording medium 41, and a belt driving roller 17 and a driven roller 16 around which the transport belt 18 is stretched. The belt driving roller 17 and the driven roller 16 cause the transport belt 18 to move. The image forming apparatus 100 further includes a sensor 22 configured to detect a density of a printing pattern printed on a surface of the transport belt 18.

The image forming apparatus 100 further includes toner cartridges 7K, 7Y, 7M and 7C as developer storage bodies configured to store toners of respective colors, and a sheet cassette 43 as a medium storage portion configured to store recording media 41. The image forming apparatus 100 further includes a hopping roller 40 as a medium feeder configured to teed the recording medium 41 from the sheet cassette 43, a medium transport path 42 through which the recording medium 41 is transported, a pair of registration rollers 44 and 45 disposed downstream of the hopping roller 40 along the medium transport path 42, a pair of transport rollers 46 and 47 configured to transport the recording medium 41 transported from the registration rollers 44 and 45) toward the image forming units 1K, 1Y, 1M and 1C. The image forming apparatus 100 further includes a fixing device 50 configured to fix a toner image to the recording medium 41, two pairs of ejection rollers 48 and 49 configured to eject the recording medium 41 to which the toner image is fixed, and a stacker portion 103 on which the recording medium 41 ejected by the ejection rollers 48 and 49 is placed.

The image forming apparatus 100 further includes a main controller 70 configured to control a printing operation (i.e., an image formation) and the like of the image forming apparatus 100, an I/F (interface) controller 71 configured to process data received from a host device, a receiving memory 72 configured to perform storage and the like of printing data inputted from the host device and the like, an image data editing memory 73 configured to perform edition and the like of the printing data temporarily stored in the receiving memory 72 and the like, a panel 90 configured to display a state of the image forming apparatus 100, operation keys 91 with which an operator inputs instructions to the image forming apparatus 100, and sensors 92 including a density sensor 93 and other various sensors for monitoring an operating state of the image forming apparatus 100.

The image forming units 1K, 1Y, 1M and 1C are arranged in the order of the image forming unit 1K, the image forming unit 1Y, the image forming unit 1M and the image forming unit 1C in a direction from upstream to downstream in a medium transport direction (from the right to the left in FIG. 1). The image forming units 1K, 1Y, 1M and 1C are detachably mounted to a main body of the image forming apparatus 100.

The image forming units 1K, 1Y, 1M and 1C respectively include photosensitive drums 4K, 4Y, 4M and 4C as image bearing bodies configured to bear toner images as developer images, developing units 2K, 2Y, 2M and 2C configured to develop electrostatic latent images with toners as developers, exposure heads 3K, 3Y, 3M and 3C as exposure devices configured to emit light to expose surfaces of the photosensitive drums 4K, 4Y, 4M and 4C to form electrostatic latent images, charging rollers 5K, 5Y, 5M and 5C as charge members configured to uniformly charge the surfaces of the photosensitive drums 4K, 4Y, 4M and 4C, cleaning blades 11K, 11Y, 11M and 11C configured to scrape off the toners remaining on the surfaces of the photosensitive drums 4K, 4Y, 4M and 4C, and blade holders 12 (i.e., holders) as holder portions configured to hold the cleaning blades 11K, 11Y, 11M and 11C with respect to main bodies of the image forming units 1K, 1Y, 1M and 1C. However, the image forming units 1K, 1Y, 1M and 1C are not limited to the above described configurations. For example, the exposure heads 3K, 3Y, 3M and 3C may be fixed to an inner side of a top cover as a lid of the image forming apparatus 100.

The developing units 2K, 2Y, 2M and 2C respectively include developing rollers 6K, 6Y, 6M and 6C as developer bearing bodies configured to supply the toners to the surfaces of the photosensitive drums 4K, 4Y, 4M and 4C, and developing blades 8K, 8Y, 8M and BC as developer regulation members configured to regulate thicknesses of toner layers formed on surfaces of the developing rollers 6K, 6Y, 6M and 6C, and supply rollers 9K, 9Y, 9M and 9C as supply members configured to supply the toners to the developing rollers 6K, 6Y, 6M and 6C. The toner cartridges 7K, 7Y, 7M and 7C are detachably mounted to the developing units 2K, 2Y, 2M and 2C.

Each of the photosensitive drums 4K, 4Y, 4M and 4C is in the form of a drum, and includes a conductive support body and a photosensitive layer formed on the conductive support body. The photosensitive drums 4K, 4Y, 4M and 4C are driven by driving motors 84K, 84Y, 84M and 84C described later, and rotate clockwise in FIG. 1.

The transfer rollers 10K, 10Y, 10M and 10C are respectively disposed so as to face the photosensitive drums 4K, 4Y, 4M and 4C via the transport belt 18. The transfer rollers 10K, 10Y, 10M and 10C are applied with transfer voltages for transferring the toner images from the photosensitive drums 4K, 4Y, 4M and 4C to the recording medium 41 by Coulomb force.

The transport belt 18 is disposed so as to move through between the photosensitive drums 4K, 4Y, 4M and 4C and the transfer rollers 10K, 10Y, 10M and 10C. The transport belt 18 is configured to hold the recording medium 41 on a surface thereof by adsorption and transport the recording medium 41.

The belt driving roller 17 is disposed downstream of the transfer rollers 10K, 10Y, 10M and 10C in the medium transport direction. The belt driving roller 17 rotates to cause the transport belt 18 to move (i.e., rotate), and applies a certain tension to the transport belt 18.

The driven roller 16 is disposed upstream of the transfer rollers 10K, 10Y, 10M and 10C in the medium transport direction. The driven roller 16 applies a certain tension to the transport belt 18.

The transport belt 18 is stretched around the belt driving roller 17 and the driven roller 16. When the belt driving roller 17 rotates by receiving a driving force, the transport belt 18 moves (rotates).

The sensor 22 is disposed so as to face the transport belt 18, and detects a density of a printing pattern printed on the surface of the transport belt 18.

The sheet cassette 43 is detachably mounted to the main body of the image forming apparatus 100. The sheet cassette 43 stores a stack of a plurality of recording media 41.

The hopping roller 40 is disposed so as to contact a surface of an uppermost recording medium 41 stored in the sheet cassette 43. The hopping roller 40 rotates to feed the recording medium 41 into the medium transport path 42.

The registration rollers 44 and 45 start rotating when a predetermined standby time elapses after the recording medium 41 reaches a nip portion between the registration rollers 44 and 45 so as to correct a skew of the recording medium 41, and transport the recording medium 41 towards the transport rollers 46 and 47.

The transport rollers 46 and 47 rotate to transport the recording medium 41 (transported from the registration rollers 44 and 45) toward the image forming units 1K, 1Y, 1M and 1C.

The fixing device 50 is disposed downstream of the image forming units 1K, 1Y, 1M and 1C along the medium transport path 42. The fixing device 50 includes a fixing roller 19 having an internal heater (for example, a halogen lamp) for heating the recording medium 41, and a fixing backup roller 20 (i.e., a pressure roller) for pressing the recording medium 41 against the fixing roller 19. The fixing device 50 applies heat and a pressure to the recording medium 41 (to which the toner image is transferred) to fix the toner image to the recording medium 41.

The ejection rollers 48 and 49 are disposed downstream of the fixing device 50 along the medium transport path 42. The ejection rollers 48 and 49 eject the recording medium 41 (to which the toner image is fixed) to the stacker portion 103.

The stacker portion 103 is disposed on the top cover of the image forming apparatus 100. The recording medium 41 ejected by the ejection rollers 48 and 49 is placed on the stacker portion 103.

Figure 2:
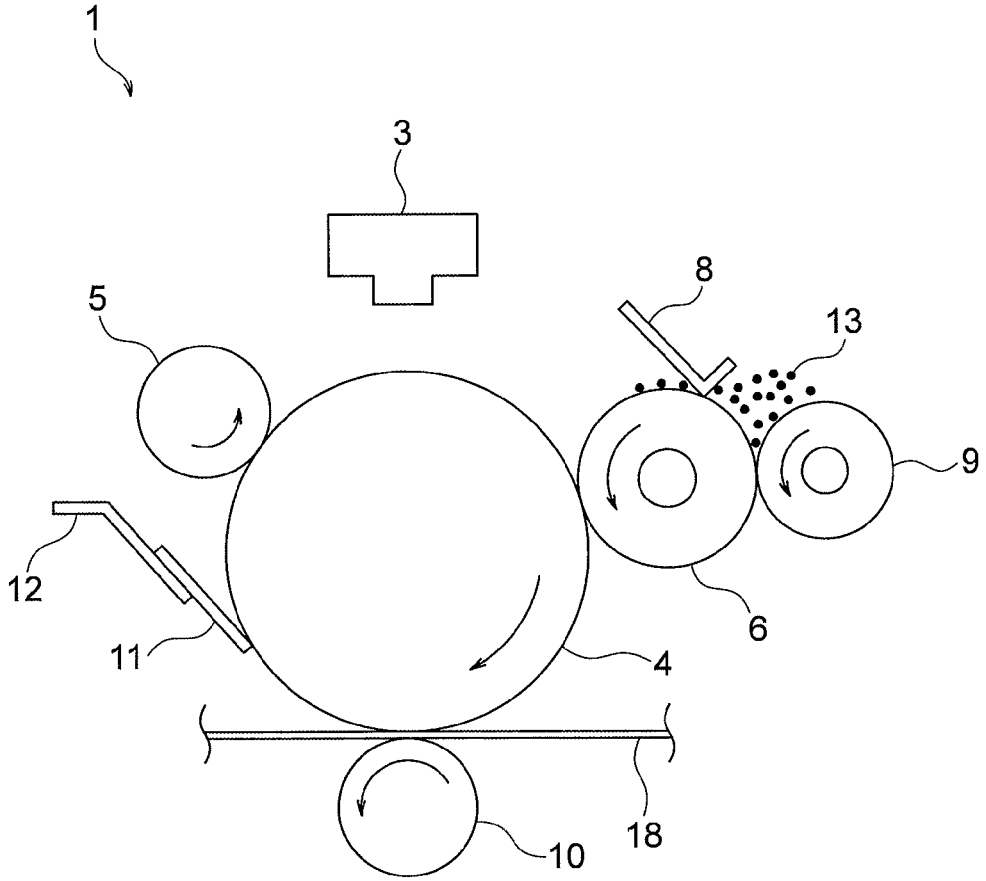
FIG. 2 is a sectional view illustrating a configuration of an image forming unit of the image forming apparatus of Embodiment 1.

FIG. 2 is a sectional view illustrating a configuration of one (hereinafter referred to as "the image forming unit 1") of the image forming units 1K, 1Y, M and 1C. In this regard, the configuration illustrated in FIG. 2 is common to the image forming units 1K, 1Y, 1M and 1C.

The image forming units 1K, 1Y, M and 1C includes same elements. For example, the photosensitive drums 4K, 4Y, 4M and 4C have the same configuration. Therefore, each of the photosensitive drums 4K, 4Y, 4M and 4C is referred to as the "photosensitive drum 4". Same can be said to other elements. Each of the charging rollers 5K, 5Y, 5M and 5C is referred to as the "charging roller 5". Each of the exposure heads 3K, 3Y, 3M and 3C is referred to as the "exposure head 3". Each of the developing rollers 6K, 6Y, 6M and 6C is referred to as the "developing roller 6". Each of the supply rollers 9K, 9Y, 9M and 9C is referred to the "supply roller 9". Each of the developing blades 8K, 8Y, 8M and 8C is referred to as the "developing blade 8". Each of the cleaning blades 11K, 11Y, 11M and 11C is referred to as the "cleaning blade 11".

The photosensitive drum 4 includes the conductive support body having a cylindrical shape, and the photosensitive layer formed on a surface of the conductive support body. The conductive support body of the photosensitive drum 4 is formed of metal (to be more specific, aluminum). The photosensitive layer of the photosensitive drum 4 is of a lamination type, and includes a charge generation layer a charge transport layer which are laminated. The charge generation layer contains a charge generation substance, and the charge transport layer contains a charge transport substance.

In this regard, a material of the conductive support body of the photosensitive drum 4 may be aluminum, aluminum alloy, stainless steel, copper, nickel or the like. Further, the material of the conductive support body of the photosensitive drum 4 is not limited to metal, but may be a resin to added with conductive fine particles (for example, metal, carbon, tin oxide or the like).

The photosensitive layer of the photosensitive drum 4 is not limited to the lamination type in which laminated the charge generation layer containing the charge generation substance and the charge transport layer containing the charge transport substance are laminated. For example, the photosensitive layer of the photosensitive drum 4 may be a single layer type photosensitive layer in which photoconductive material is dissolved or distributed in a binder resin. The single layer type photosensitive layer is positively chargeable, and the lamination type photosensitive layer is negatively chargeable. In the case of the lamination type photosensitive layer, a base layer is formed between the surface of the conductive support body and the photosensitive layer. The base layer includes a binder resin to which metal oxide (for example, titanium oxide) is distributed in order to enhance adhesiveness and blocking property.

The photosensitive drum 4 is manufactured by forming the base layer, the charge generation layer and the electric charge transport layer on the surface of the conductive support body in this order using an immersion coating method. However, a manufacturing method of the photosensitive drum 4 is not limited to the immersion coating method. For example, the photosensitive drum 4 may be manufactured using a spray coating method, a blade coating method or the like.

In the immersion coating method, the conductive support body is immersed (dipped) in a coating liquid formed by distributing metal oxide particles in a solution in which a binder resin (for example, epoxy resin polyethylene resin or the like) is dissolved. Then, the conductive support body is pulled out from the coating liquid, and is dried, so that the base layer is formed on the surface of the conductive support body. Subsequently, the conductive support body is immersed in a coating liquid in which the charge generation substance is distributed in a solution in which a binder resin (for example, polyvinyl butyral resin, polyvinyl formal resin, or the like) is dissolved. Then, the conductive support body is pulled out from the coating liquid, so that the charge generation layer is formed on the base layer. Subsequently, the conductive support body is immersed in a coating liquid in which the charge transport substance is distributed in a solution in which a binder resin (for example, polyvinyl butyral resin, polyvinyl formal resin, or the like) is dissolved. Then, the conductive support body is pulled out from the coating liquid, so that the charge transport layer is formed on the charge generation layer.

An outer diameter of the photosensitive drum 4 is, for example, 30 mm. A thickness of the photosensitive layer (i.e., the charge generation layer and the charge transport layer) is, for example, 21 μm.

The charging roller 5 is disposed so as to face the surface of the photosensitive drum 4, and rotates following a rotation of the photosensitive drum 4. The charging roller 5 includes, for example, a metal shaft and a roller portion of semiconductive epichlorohydrin rubber provided on the metal shaft. The charging rollers 5K, 5Y, 5M and 5C are respectively applied with charge voltages by charge voltage controllers 74K, 74Y, 74M and 74C described later, and uniformly charge the surfaces of the photosensitive drums 4K, 4Y, 4M and 4C.

The exposure head 3 includes a light emitting element array in which a plurality of LEDs (Light Emitting Diodes) are arranged in one direction, and a lens array in which a plurality of lenses are arranged in the same direction. The exposure head 3 is configured so that light emitted by each LED is focused on the surface of the photosensitive drum 4 by the lens.

The developing roller 6 is disposed so as to face the surface of the photosensitive drum 4, and rotates in a direction opposite to a rotating direction of the photosensitive drum 4 (so that surfaces of the developing roller 6 and the photosensitive drum 4 facing each other move in the same direction). The developing roller 6 includes, for example, a metal shaft and a roller portion of semiconductive urethane rubber provided on a surface of the metal shaft. The developing rollers 6K, 6Y, 6M and 6C are respectively applied with developing voltages by developing voltage controllers 76K, 76Y, 76M and 76C described later, and develop electrostatic latent images on the surfaces of the photosensitive drums 4K, 4Y, 4M and 4C.

The supply roller 9 is disposed so as to face the surface of the developing roller 6, and rotates in the same direction as a rotating direction of the developing roller 6 (so that surfaces of the supply roller 9 and the photosensitive drum 4 facing each other move in opposite directions). The supply roller 9 includes, for example, a metal shaft and a roller portion of semiconductive urethane rubber provided on the surface of the metal shaft. Further, the supply rollers 9K, 9Y, 9M and 9C are respectively applied with supply voltages by supply voltage controllers 78K, 78Y, 78M and 78C described later, and supply the toners 13 to the developing rollers 6K, 6Y, 6M and 6C.

The developing blade 8 is formed of, for example, an elongated plate-like member of stainless steel. The developing blade 8 is bent so that a cross sectional shape taken along a plane perpendicular to a longitudinal direction thereof is a substantially L-shape. The developing blade 8 is disposed so that an outer side of a bent portion contacts a surface of the developing roller 6. Further, the developing blades 8K, 8Y, 8M and 8C are respectively applied with blade voltages by blade voltage controllers 77K, 77Y, 77M and 77C described later, and control charging amounts of the toner layers on the developing rollers 6K, 6Y, 6M and 6C.

The image forming apparatus 100 uses, for example, a nonmagnetic single component developing method. The toner 13 used in the image forming apparatus 100 is a nonmagnetic single component toner (developer). To be more specific, the toner 13 is, for example, a polymerization toner having a mean particle diameter of 7.38 μm. The toner 13 used in the image forming apparatus 100 preferably includes mother particles containing at least a resin and a coloring agent, and external additives added to surfaces of the mother particles. The mother particles are manufactured by an emulsion polymerization method. A mean particle diameter of the external additives is, for example, in a range from 5 to 400 nm. An amount of the external additives added to 100 weight parts of the mother particles is preferably in range from 0.5 to 8.0 weight parts, more preferably in range from 1.5 to 6.0 weight parts, and further preferably in a range from 1.5 to 5.0 weight parts.

The toner 13 used in the image forming apparatus 100 includes melamine, medium sized silica, organic fine particles, and silica spacer, as the external additives. A mean particle diameter of melamine is, for example, in a range from 100 to 300 nm. A mean particle diameter of medium sized silica is, for example, in a range from 5 to 400 nm. A mean particle diameter of organic fine particles is, for example, in a range from 100 to 400 nm. A mean particle diameter of silica spacer is, for example, 100 nm. Amounts (weight parts) of the external additives can be determined by a ratio of a spectral intensity obtained by analyzing a composition of the toner using an energy dispersion type X-ray spectrometer (EDX), an FT-IR (Fourier-Transform-Infrared-Spectroscopy) or the like to a spectral intensity obtained when a known amount of the external additives are added. The ratio between the spectral intensities and the amounts (weight parts) are proportional to each other.

The transfer roller 10 is disposed so that the transfer roller 10 and the photosensitive drum 4 sandwich the transport belt 18 therebetween. The transfer roller 10 rotates following the rotation of the photosensitive drum 4 (i.e., a movement of the transport belt 18). The transfer roller 10 includes, for example, a metal shaft and a roller portion provided on a surface of the metal shaft. The roller portion is formed of a foam rubber such as acrylonitrile butadiene rubber (NBR) or the like. The transfer rollers 10K, 10Y, 10M and 10C are respectively applied with transfer voltages by transfer voltage controllers 79K, 79Y, 79M and 79C, and transfer the toner images from the surfaces of the photosensitive drums 4K, 4Y, 4M and 4C to the recording medium 41.

<Configuration of Cleaning Blade 11>

Figure 3A:
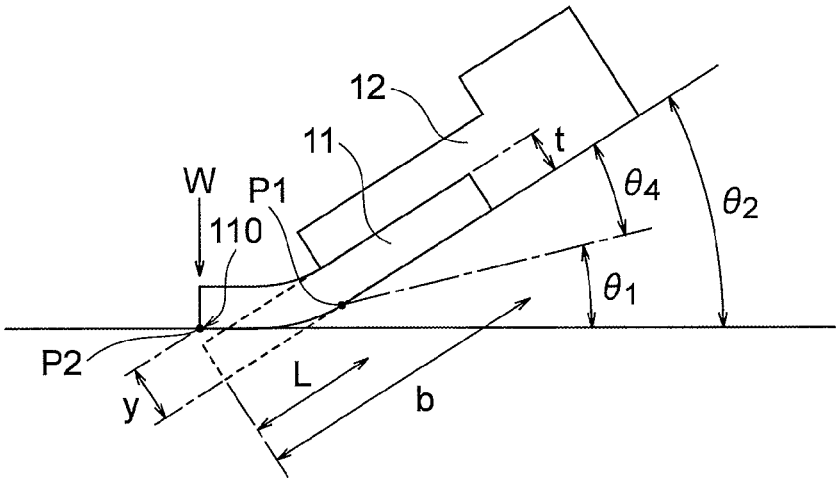
FIG. 3A is a sectional view illustrating a positional relationship between a cleaning blade and a photosensitive drum.
Figure 3B:
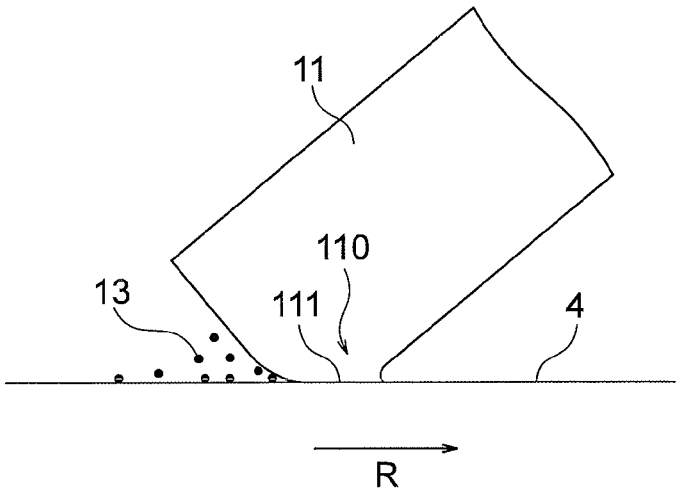
FIG. 3B is a sectional view illustrating a state where a contact portion of the cleaning blade contacts the photosensitive drum.

FIG. 3A is a sectional view schematically illustrating a positional relationship between the cleaning blade 11 and the photosensitive drum 4. FIG. 3B is a sectional view schematically illustrating a state in which the cleaning blade 11 contacts the photosensitive drum 4.

The cleaning blade 11 is disposed between a nip portion between the photosensitive drum 4 and the transfer roller 10 and another nip portion between the photosensitive drum 4 and the charging roller 5 in the rotating direction of the photosensitive drum 4. In other words, the cleaning blade 11 is disposed upstream of the charging roller 5 (i.e., downstream of the transfer roller 10) in the rotating direction of the photosensitive drum 4. The cleaning blade 11 has a corner portion 110 as a contact portion (i.e., an end portion) that contacts the surface of the photosensitive drum 4. The corner portion 110 of the cleaning blade 11 is pressed against the surface of the photosensitive drum 4. When the photosensitive drum 4 rotates, the corner portion 110 scrapes off residues (including the toner 13, the external additives or the like) remaining on the surface of the photosensitive drum 4, and removes the toner 13, the external additives or the like from the surface of the photosensitive drum 4. The cleaning blade 11 is an elongated blade member extending in an axial direction of the photosensitive drum 4. The cleaning blade 11 is formed of an elastic body (i.e., a resilient body) such as rubber (to be more specific, urethane rubber).

The cleaning blade 11 is fixed by the blade holder 12 to the main body of the image forming unit 1. In this regard, in an example shown in FIG. 2, the blade holder 12 includes a horizontal portion extending horizontally, and an inclined portion inclined obliquely downward (i.e., toward an outer circumference of the photosensitive drum 4). However, the blade holder 12 is not limited to such a shape. For example, the blade holder 12 may be a flat plate member.

As shown in FIGS. 3A and 3B, in a plane perpendicular to a longitudinal direction of the cleaning blade 11 (i.e., the axial direction of the photosensitive drum 4), the cleaning blade 11 has a rectangular cross sectional shape, and the corner portion 110 contacts the surface of the photosensitive drum 4.

The portion of the cleaning blade 11 projecting from the blade holder 12 toward the photosensitive drum 4 is referred to as a free end. In other words, the free end of the cleaning blade 11 is a portion from a deformation starting point P1 to the end portion (i.e., the corner portion 110) contacting the surface of the photosensitive drum 4. A length of the free end of the cleaning blade 11 is referred to as a free end length L. The free end length L of the cleaning blade 11 is, for example, 7.9 mm. A thickness of the free end of the cleaning blade 11 is, for example, 2 mm.

An angle $\theta_1$ between a tangential line (i.e., a tangential direction) at the deformation starting point P1 of the cleaning blade 11 and a tangential line (i.e., a tangential direction) at a point P2 where the corner portion 110 contacts the photosensitive drum 4 is, for example, in a range from 10 to 15 degrees. This angle $\theta_1$ is referred to as a cleaning angle of the cleaning blade 11 with respective to the photosensitive drum 4. Here, a method for determining the cleaning angle $\theta_1$ will be described.

In FIG. 3A, an angle between the tangential direction of the surface of the photosensitive drum 4 at the point P2 where the cleaning blade 11 (to be more specific, the corner portion 110) contacts the photosensitive drum 4 and a generatrix direction of the cleaning blade 11 is defined as an initial setting contact angle $\theta_2$. The cleaning blade 11 is resiliently deformed by being pressed against the surface of the photosensitive drum 4. An angle between a tangential line (i.e., a tangential direction) at the deformation starting point P1 of the resiliently deformed cleaning blade 11, and the generatrix direction of the cleaning blade 11 is referred to as a blade displacement angle $\theta_4$. The cleaning angle $\theta_1$ is obtained by subtracting the blade displacement angle $\theta_4$ from the initial setting contact angle $\theta_2$ (i.e., $\theta_2-\theta_4$). In this regard, the deformation starting point P1 of the cleaning blade 11 corresponds to a starting position of the free end of the cleaning blade 11 (i.e., a projection starting position from the blade holder 12).

A linear pressure W (i.e., a pressing force) with which the cleaning blade 11 is pressed against the surface of the photosensitive drum 4 is, for example, in a range from 12 gf/cm to 24 gf/cm.

A pressing amount of the cleaning blade 11 against the photosensitive drum 4 is expressed as "y". Using the free end length L and the pressing amount y, the blade displacement angle $\theta_4$ is represented by the following formula (1):

$$\theta_4 = \frac{3 \times y}{2 \times L} \tag{1}$$

An entire length of the cleaning blade 11 is expressed as "b" (mm), and a thickness of the cleaning blade 11 is expressed as "t" (mm). A second moment of area I of the cleaning blade 11 is represented by the following formula (2):

$$I = \frac{b \times t^3}{12} \tag{2}$$

A Young's modulus of the cleaning blade 11 is expressed as E (gf/mm$^2$). The linear pressure W (i.e., the pressing force) with which the cleaning blade 11 is pressed against the surface of the photosensitive drum 4 is represented by the following formula (3):

$$W = \frac{3 \times E \times I \times y}{b \times L^3} = \frac{E \times t^3 \times y}{4 \times L^3} \tag{3}$$

In Embodiment 1, the free end length L and the pressing amount y are determined based on the Young's modulus E of the cleaning blade 11 so that the linear pressure W is, for example, in a range from 12 to 24 gf/cm.

As the corner portion 110 is pressed against the surface of the photosensitive drum 4 as shown in FIG. 3B, the cleaning blade 11 is resiliently deformed, and forms a blade nip 111. When the photosensitive drum 4 rotates in a direction shown by an arrow R, the blade nip 111 repeatedly deforms (and is stretched) in the rotating direction of the photosensitive drum 4 and recovers its original shape. In other words, the blade nip 111 repeats a stick-slip motion. As the corner portion 110 repeats the stick-slip motion, the cleaning blade 11 flicks and scrapes off the toner 13 and the like remaining on the surface of the photosensitive drum 4.

<Control System of Image Forming Apparatus>

Figure 4:
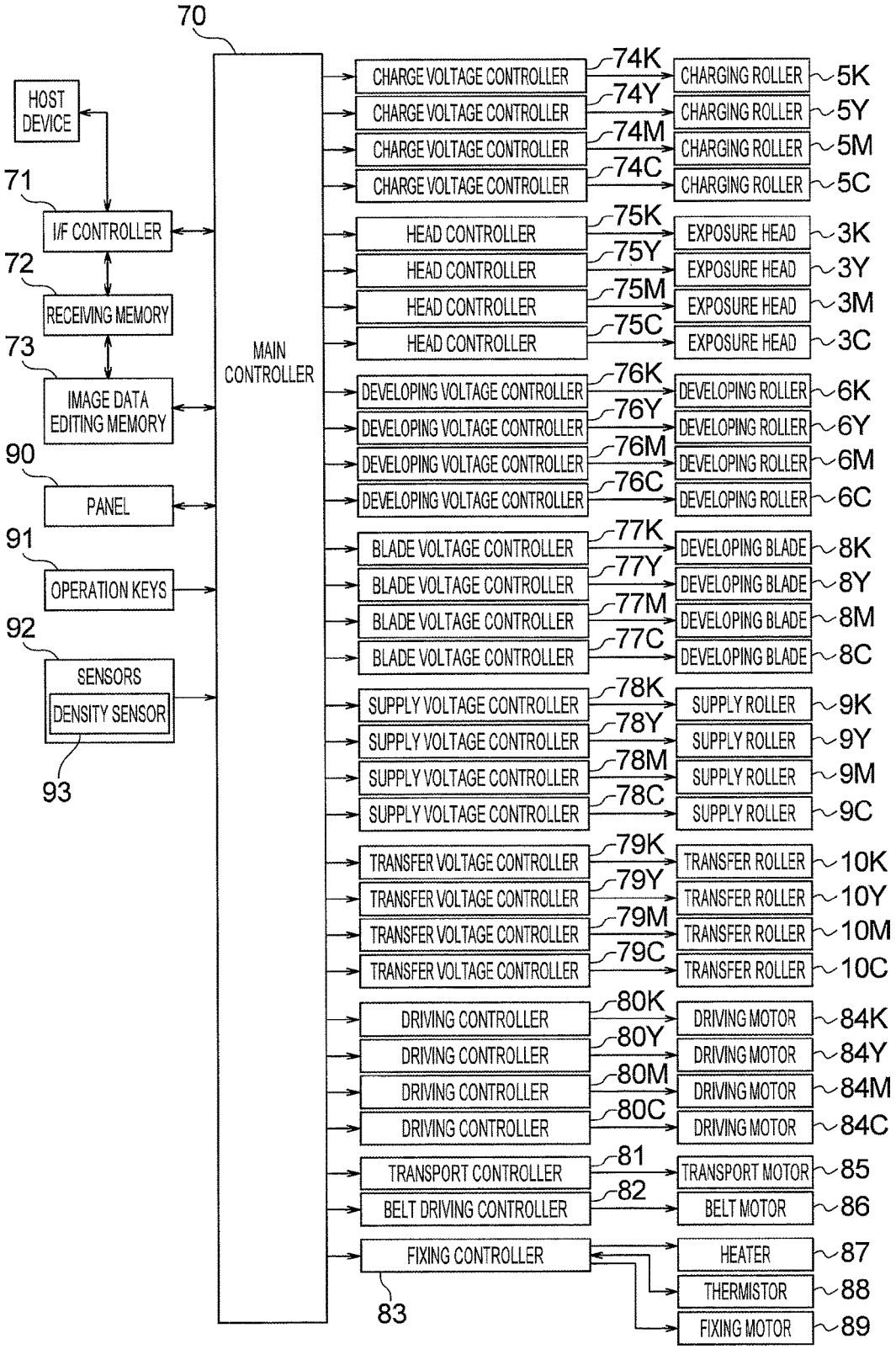
FIG. 4 is a block diagram illustrating a control system of the image forming apparatus of Embodiment 1.

Next, a control system of the image forming apparatus 100 will be described. FIG. 4 is a block diagram illustrating the control system of the image forming apparatus 100.

As described above, the image forming apparatus 100 includes the main controller 70, the I/F (interface) controller 71, the receiving memory 72, the image data editing memory 73, the panel 90, the operation keys 91, and the sensors 92 (including the density sensor 93).

The main controller 70 has a microprocessor, a ROM (Read Only Memory), a RAM (Random Access Memory), an input-output port, a timer, or the like. The main controller 70 receives printing data and control commands from, for example, a host device such as a personal computer via the I/F controller 71, and controls the printing operation (i.e., image formation) of the image forming apparatus 100.

The I/F controller 71 transmits information on the image forming apparatus 100 (i.e., printer information) to the host device. The I/F controller 71 analyzes command received from the host device, and processes data received from the host device.

The receiving memory 72 temporarily stores the printing data received from the host device via the I/F controller 71 for every color.

The image data editing memory 73 edits the printing data temporarily stored in the receiving memory 72 into image data, and stores the image data.

The panel 90 has a display (for example, LEDs) for displaying a state of the image forming apparatus 100.

The operation keys 91 are operated by an operator for inputting instructions to the image forming apparatus 100.

The sensors 92 include various sensors for monitoring an operation state of the image forming apparatus 100. The sensors 92 include, for example, a plurality of medium position sensor (i.e., transport sensors) for detecting positions of the recording medium 41, a temperature sensor, a humidity sensor and the density sensor 93 for detecting an image density. Output signals of the sensors 92 are inputted into the main controller 70.

The image forming apparatus 100 further includes the charge voltage controllers 74K, 74Y, 74M and 74C, the head controllers 75K, 75Y, 75M and 75C, the developing voltage controllers 76K, 76Y, 76M and 76C, the blade voltage controllers 77K, 77Y, 77M and 77C, the supply voltage controllers 78K, 78Y, 78M and 78C, and the transfer voltage controllers 79K, 79Y, 79M and 79C. The image forming apparatus 100 further includes driving controllers (i.e., image formation driving controllers) 80K, 80Y, 80M and 80C, a transport controller 81, a belt driving controller 82, and a fixing controller 83.

The charge voltage controllers 74K, 74Y, 74M and 74C respectively control the charge voltages applied to the charging rollers 5K, 5Y, 5M and 5C for uniformly charging the surfaces of the photosensitive drums 4K, 4Y, 4M and 4C, according to instructions from the main controller 70.

The head controllers 75K, 75Y, 75M and 75C control light emission of the exposure heads 3K, 3Y, 3M and 3C to expose the surfaces of the photosensitive drums 4K, 4Y, 4M and 4C based on image data of respective colors stored in the image data editing memory 73, according to instructions from the main controller 70.

The developing voltage controllers 76K, 76Y, 76M and 76C control the developing voltages applied to the developing rollers 6K, 6Y, 6M and 6C for developing the electrostatic latent images on the surfaces of the photosensitive drums 4K, 4Y, 4M and 4C, according to instructions from the main controller 70.

The blade voltage controllers 77K, 77Y, 77M and 77C control the blade voltages applied to the developing blades 8K, 8Y, 8M and 8C for controlling charging amounts of the toners 13 on the developing rollers 6K, 6Y, 6M and 6C, according to instructions from the main controller 70.

The supply voltage controllers 78K, 78Y, 78M and 78C control the supply voltages applied to the supply rollers 9K, 9Y, 9M and 9C for supplying the toners 13 to the developing rollers 6K, 6Y, 6M and 6C, according to instructions from the main controller 70.

The transfer voltage controllers 79K, 79Y, 79M and 79C control the transfer voltages applied to the transfer rollers 10K, 10Y, 10M and 10C for transferring the toner images from the photosensitive drums 4K, 4Y, 4M and 4C to the recording medium 41, according to instructions from the main controller 70.

The driving controllers 80K, 80Y, 80M and 80C control driving motors 84K, 84Y, 84M and 84C which are driving sources of the image forming units 1K, 1Y, 1M and 1C, according to instructions from the main controller 70.

Rotations of the driving motors 84K, 84Y, 84M and 84C are transmitted to the photosensitive drums 4K, 4Y, 4M and 4C, the developing rollers 6K, 6Y, 6M and 6C, and the supply rollers 9K, 9Y, 9M and 9C. The charging rollers 5K, 5Y, 5M and 5C rotate following the rotations of the photosensitive drums 4K, 4Y, 4M and 4C.

The transport controller 81 controls a transport motor 85 and clutches to rotate respective rollers (i.e., the hopping roller 40, the registration rollers 44 and 45, and the transport rollers 46 and 47) for feeding and transporting the recording medium 41, according to an instruction from the main controller 70.

The belt driving controller 82 controls a belt motor 86 to rotate the belt driving roller 17 for moving the transport belt 18, according to an instruction from the main controller 70.

The fixing controller 83 performs ON/OFF control of a heater 87 provided in the fixing roller 19 based on a temperature detected by a thermistor 88 provided in the fixing device 50 for maintaining a surface temperature of the fixing roller 19 at a constant temperature, according to an instruction from the main controller 70. The fixing controller 83 also controls a fixing motor 89 for rotating the fixing roller 19 in a state where the fixing device 50 reaches a predetermined temperature. In this regard, a rotation of the fixing motor 89 is also transmitted to the ejection rollers 48 and 49.

The fixing backup roller 20 rotates following a rotation of the fixing roller 19.

In this regard, in the case where the image forming apparatus 100 further includes a lifting mechanism (i.e., an up-down mechanism) for vertically moving the image forming units 1K, 1Y, 1M and 1C, the image forming apparatus 100 may further include a lifting controller for controlling a lifting motor (i.e., an up-down motor) for driving the lifting mechanism.

<Operation of Image Forming Apparatus 100>

Next, a basic operation of the image forming apparatus 100 will be described. The main controller 70 of the image forming apparatus 100 starts the printing operation (i.e., image formation) upon receiving the printing command and printing data via the I/F controller 71 from the host device.

The main controller 70 temporarily stores the printing data in the receiving memory 72, edits the stored printing data to create image data, and stores the image data in the image data editing memory 73.

The main controller 70 further controls the transport controller 81 to drive the transport motor 85. Therefore, the hopping roller 40 rotates to feed the recording medium 41 one by one from the sheet cassette 43 into the medium transport path 42. The registration rollers 44 and 4*b* start rotating at a predetermined timing, correct the skew of the recording medium 41 and transport the recording medium 41 to the transport rollers 46 and 47. The transport rollers 46 and 47 transport the recording medium 41 toward the transport belt 18 along the medium transport path 42.

The transport belt 18 moves by the rotation of the belt driving roller 17. The transport belt 18 holds the recording medium 41 by adsorption, and transports the recording medium 41 through the image forming units 1K, 1Y, 1M and 1C.

The main controller 70 controls respective controllers to cause the image forming units 1K, 1Y, 1M and 1C to start formation of toner images of respective colors.

The charge voltage controllers 74K, 74Y, 74M and 74C apply the charge voltages to the charging rollers 5K, 5Y, 5M and 5C. The developing voltage controllers 76K, 76Y, 76M and 76C apply the developing voltages to the developing rollers 6K, 6Y, 6M and 6C. The blade voltage controllers 77K, 77Y, 77M and 77C apply the blade voltages to the developing blades 8K, BY, 8M and 8C. The supply voltage controllers 78K, 78Y, 78M and 78C apply the supply voltages to the supply rollers 9K, 9Y, 9M and 9C.

The main controller 70 controls the driving controllers 80K, 80Y, 80M and 80C to rotate the driving motors 84K, 84Y, 84M and 84C. The driving motors 84K, 84Y, 84M and 84C cause the photosensitive drums 4K, 4Y, 4M and 4C to rotate. When the photosensitive drums 4K, 4Y, 4M and 4C rotate, the charging rollers 5K, 5Y, 5M and 5C, the developing rollers 6K, 6Y, 6M and 6C, and the supply rollers 9K, 9Y, 9M and 9C also rotate.

The charging rollers 5K, 5Y, 5M and 5C uniformly charges the surfaces of the photosensitive drums 4K, 4Y, 4M and 4C.

The main controller 70 controls the head controllers 75K, 75Y, 75M and 75C based on the image data stored in the image data editing memory 73.

The head controllers 75K, 75Y, 75M and 75C cause the exposure heads 3K, 3Y, 3M and 3C to emit light to the surfaces of the photosensitive drums 4K, 4Y, 4M and 4C, so as to form electrostatic latent images on the surfaces of the photosensitive drums 4K, 4Y, 4M and 4C.

The electrostatic latent images formed on the surfaces of the photosensitive drums 4K, 4Y, 4M and 4C are developed with the toners 13 supplied by the developing rollers 6K, 6Y, 6M and 6C. As the electrostatic latent images formed on the surfaces of the photosensitive drums 4K, 4Y, 4M and 4C are developed, toner images are formed on the surfaces of the photosensitive drums 4K, 4Y, 4M and 4C.

When the toner images on the rotating photosensitive drums 4K, 4Y, 4M and 4C reach the surface of the transport belt 18, the transfer voltage controllers 79K, 79Y, 79M and 79C apply the transfer voltages respectively to the transfer rollers 10K, 10Y, 10M and 10C. With the transfer voltages, the toner images are transferred from the surfaces of the photosensitive drums 4K, 4Y, 4M and 4C to the recording medium 41 on the transport belt 18.

The toners 13 which are not transferred to the recording medium 41 but remain on the surfaces of the photosensitive drums 4K, 4Y, 4M and 4C are scraped off by the cleaning blades 11K, 11Y, 11M and 11C.

The toner images of respective colors formed by the image forming units 1K, 1Y, 1M and 1C are transferred one by one to the recording medium 41 in an overlapping manner. The recording medium 41 to which the toner images of respective colors are transferred is transported by the transport belt 18, and reaches the fixing device 50.

In the fixing device 50, the recording medium 41 is introduced into a nip portion between the fixing roller 19 and the fixing backup roller 20. The recording medium 41 is pressed and heated in the nip portion between the fixing roller 19 and the fixing backup roller 20, and the toner image is fixed to the recording medium 41.

The recording medium 41 to which the toner image is fixed is ejected by the ejection rollers 48 and 49 to outside of the image forming apparatus 100, and is placed on the stacker portion 103. With this, the printing operation (i.e., image formation) of the color image on the recording medium 41 is completed.

<Cleaning Operation of Cleaning Blade 11>

Next, a cleaning operation of the cleaning blade 11 will be described.

Figure 5A:
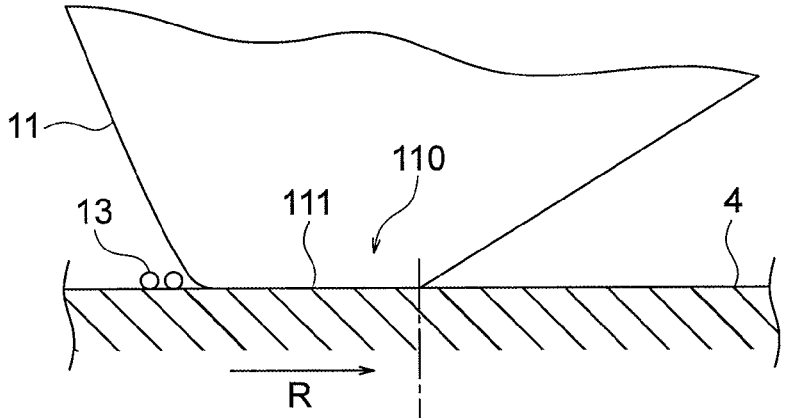
FIGS. 5A, 5B and 5C are sectional views schematically illustrating a stick-slip movement at a contact portion between the cleaning blade and the photosensitive drum.
Figure 5B:
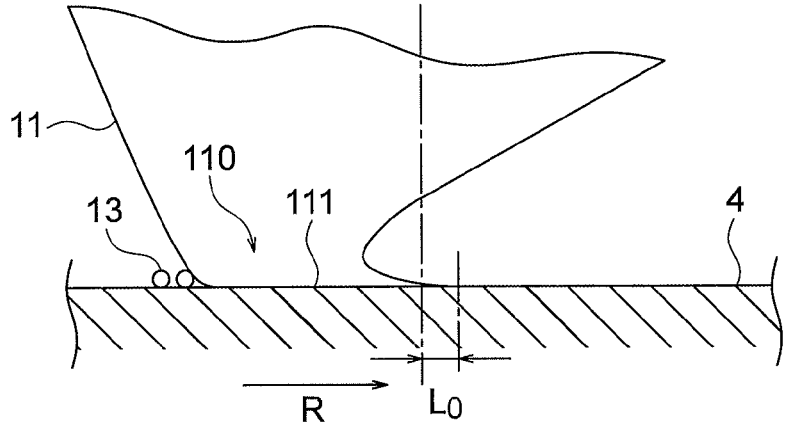
Figure 5C:
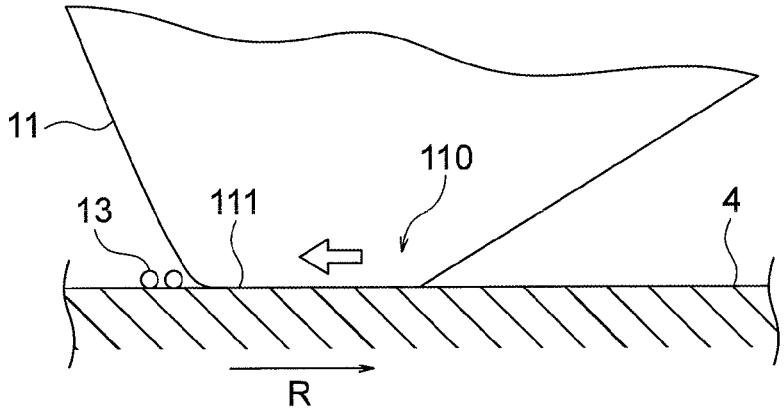

FIGS. 5A, 5B and 5C are sectional views schematically illustrating the stick-slip motion that occurs in the contact portion between the cleaning blade 11 and the photosensitive drum 4. The surface of the photosensitive drum 4 is illustrated as a flat surface in FIGS. 5A, 5B and 5C. Dot-and-dash lines in FIGS. 5A and 5B indicate a relationship between corresponding positions of the cleaning blade 11 in FIGS. 5A and 5B.

The cleaning blade 11 contacts the surface of the photosensitive drum 4 in such a manner that the corner portion 110 is pressed against the surface of the photosensitive drum 4, and scrapes off the toner 13 (i.e., a residual toner) adhering to the surface of the photosensitive drum 4.

As shown in FIG. 5A, the blade nip 111 is formed along the surface of the photosensitive drum 4 at a portion where the cleaning blade 11 contacts the surface of the photosensitive drum 4.

When the surface of the photosensitive drum 4 moves in the direction shown by the arrow R by the rotation of the photosensitive drum 4, the blade nip 111 is deformed as shown in FIG. 5B and is stretched in a moving direction of the surface of the photosensitive drum 4. As the blade nip 111 is stretched, an elastic force (i.e., a resilient force) of the cleaning blade 11 becomes larger.

When a static friction force between the cleaning blade 11 and the surface of the photosensitive drum 4 is balanced with the elastic force of the cleaning blade 11, the blade nip 111 slides on the surface of the photosensitive drum 4. Since a dynamic friction coefficient is smaller than a static friction coefficient, the blade nip 111 returns to its original position as shown in FIG. 3C while sliding on the surface top of the photosensitive drum 4.

The cleaning blade 11 scrapes off the toner 13 adhering to the surface of the photosensitive drum 4 by the stick-slip motion, i.e., by being deformed in the moving direction of the surface of the surface of the photosensitive drum 4 and recovering its original shape by the elastic force (i.e., a restoring force). Therefore, cleaning performance of the cleaning blade 11 depends on stick-slip characteristics.

In a recent image forming apparatus, in order to enhance image quality and to increase printing speed, a toner having a smaller particle size and a lower melting point has come into use. In many cases, the toner having a smaller particle size and a lower melting point contains a large amount of external additives (i.e., silica fine powder, a charge control agent or the like). For example, in order to charge the toner in a short time, it is necessary to increase an amount of the charge control agent in the toner to stabilize charging of the toner. As the amount of the external additives increases, part of the external additives may pass through between the cleaning blade 11 and the surface of the photosensitive drum 4. Such external additives may adhere to the surface of the charging roller 5, and may influence image formation.

The image forming apparatus 100 is required to operate in any environment from a low temperature and low humidity environment to a high temperature and high temperature environment. The cleaning blade 11 is formed of urethane rubber or the like, and rubber characteristics change with temperature. Therefore, even if the passing-through of the external additives does not occur in a general office environment (i.e., a normal temperature and normal humidity environment), the passing-through of the external additives may occur in the high temperature and high humidity environment.

Therefore, Embodiment 1 is intended to cause a suitable stick-slip motion of the cleaning blade 11 in order to suppress the passing-through of external additives.

The stick-slip motion will be described again with reference to FIGS. 5A through 5C. In FIG. 5A, the toner 13 and the like (including the external additives separated from the toner 13 and paper powder) adhering to the surface of the photosensitive drum 4 is dammed up by the cleaning blade 11, and a stationary area (i.e., a toner reservoir) is formed in the vicinity of the blade nip 111.

In a stick motion from the state shown in FIG. 5A to the state shown in FIG. 5B, the toner 13 and the like existing in the blade nip 111 and the stationary area move in the moving direction R of the surface of the photosensitive drum 4 together with the surface of the photosensitive drum 4.

In a slip motion from the state shown in FIG. 5B to the state shown in FIG. 5C, the toner 13 and the like existing in the blade nip 111 and the stationary area are pushed back in a direction opposite to the moving direction R of the surface of the photosensitive drum 4 by the elastic force of the cleaning blade 11, and are flipped and scraped off from the surface of the photosensitive drum 4.

In this stick-slip motion, the toner 13 in the stationary area is repeatedly subjected to friction between the cleaning blade 11 and the photosensitive drum 4. Such friction may cause the external additives to be separated (i.e., dropped out) from the toner 13. If the toner 13 contains large amount of the external additives, the amount of the external additives separated from the toner 13 also increases. Therefore, an amount of the toner 13 reaching between the cleaning blade 11 and the photosensitive drum 4 (i.e., the blade nip 111 and stationary area) also increases. As a result, the passing-through of the external additives is likely to occur.

Frictional heat may be generated by repeated sliding motion between the photosensitive drum 4 and the cleaning blade 11. With the frictional heat, a temperature of an edge portion (i.e., the corner portion 110) of the cleaning blade 11 becomes higher than a use environmental temperature of the image forming apparatus 100. As a speed of image formation (for example, a rotation speed of the photosensitive drum 4) becomes faster, the frictional heat becomes larger.

The cleaning blade 11 may be used in a wide range use environment from a low temperature environment to a high temperature environment. There may be cases where the passing-through of the external additives does not occur in the low temperature environment or a normal, temperature environment, but occurs in a specific temperature environment such as the high temperature environment.

Therefore, in Embodiment 1, a loss elastic modulus E" (E double prime) of the cleaning blade 11 is defined as a parameter in order to cause a suitable stick-slip motion of the cleaning blade 11 without temperature dependence, in order to suppress the passing-through of the external additives. The loss elastic modulus is a loss of mechanical energy, and generally indicates a flexibility of a sample.

In a manufacturing process of the cleaning blade 11, the cleaning blade 11 having different loss elastic moduli E" can be manufactured by, for example, changing an amount of trimethylolpropane (TMP) as a hardening agent. For example, when the amount of trimethylolpropane is increased, a change in loss elastic modulus E" can be made steeper with change in temperature. Further, the cleaning blade 11 having different loss elastic moduli E" can be manufactured by changing an amount of 1, 4-butanediol (1, 4-BD) as a hardening agent.

The change in loss elastic modulus E" is caused by introduction of chemical crosslinks by use of a polyfunctional alcohol. Alternatively, it is also possible to control the loss elastic modulus E" by changing a temperature and a humidity in a rubber forming process. As the humidity in a vulcanization process is low, the cleaning blade 11 whose loss elastic modulus E" changes less with change in temperature can be manufactured. As the humidity in the vulcanization process is high, the cleaning blade 11 whose loss elastic modulus E" largely changes with change in temperature can be manufactured.

Further, the loss elastic modulus E" can be controlled by changing a kind of polyester as a material of the cleaning blade 11. For example, the loss elastic modulus E" can be controlled by manufacturing the cleaning blade 11 using, for example, ethylene adipate (EA), butylene adipate (BA), hexamethylene adipate (HA) or the like singularly or in any combination as a long-chain polyol. For example, when the ethylene adipate is used as the material of the cleaning blade 11, the change in loss elastic modulus E" can be made steeper with change in temperature.

The loss elastic modulus E" of the cleaning blade 11 is measured by using viscoelasticity measuring instrument "DMS6100" manufactured by SII Incorporated. The measurement is performed at a frequency of 10 Hz and a temperature rising rate of 2° C./min. The measurement (i.e., rubber measurement) is performed in a tension mode as a deformation mode. A sample (i.e., a rubber sample) used in the measurement has a shape having a length of 20 mm, a width of 5 mm and a thickness of 2 mm. This thickness (2 m) is the same as a thickness of the cleaning blade 11 mounted in the image forming apparatus 100. However, the shape of the cleaning blade 11 is not limited to the above described shape. The loss elastic modulus E" of the cleaning blade 11 is measured in a temperature range from −30° C. to +150° C. However, measurement values employed to determine an exponential approximation curve is in a range from 0° C. to +100° C. In the viscoelastic measurement of the tension mode, the sample is heated by a heater of the measuring instrument, and is applied with a stress by a load generation unit of the measuring instrument via a probe. The stress is applied to the sample as a sine wave power whose frequency is set as one of measurement conditions, and the stress is applied so that a strain amplitude of the sample is constant. A deformation amount (i.e., strain) of the sample is detected by a displacement detector of the measuring instrument. A tension (or compressive force) applied to the sample need be suitably controlled depending on a state of the sample. The tension (or compressive force) applied to the sample is expressed as follows:

$$F_t = F_{base} + F_{0gain} \times F_0$$

In the above formula, $F_t$ is the tension or compressive force. $F_{base}$ (i.e., a minimum tension or compressive force) is 50 mN. $F_{0gain}$ is 1.2. $F_0$ (i.e., an amplitude of force) is 50 mN. $F_0$ is 0 in a standby state, and therefore the tension (or compressive force) is the same as the minimum tension (or compressive force). Further, during the measurement, the tension automatically changes depending on the loss elastic modulus E" of the sample and a shape factor.

Figure 6:
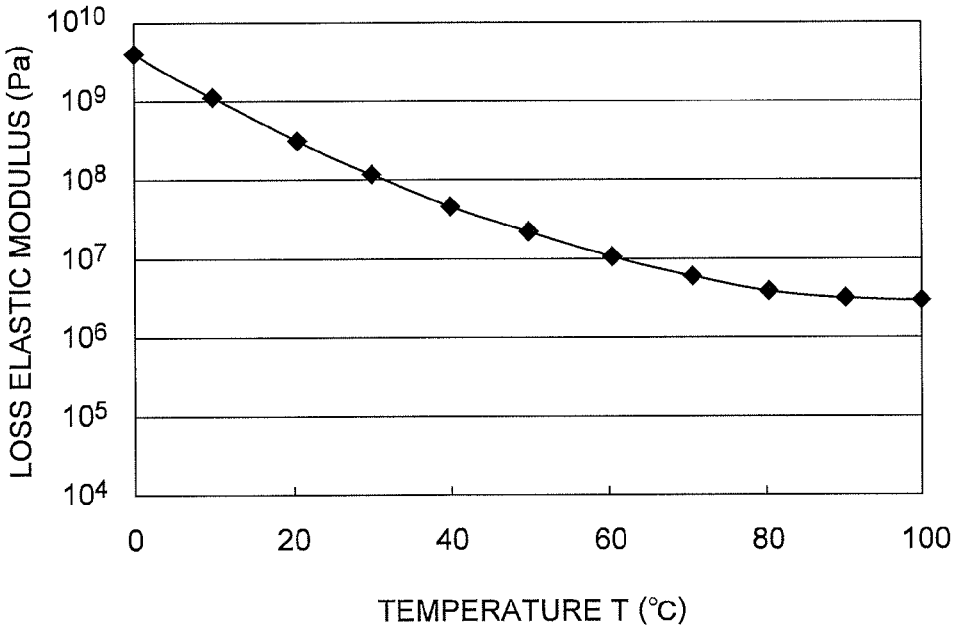
FIG. 6 is a graph illustrating an example of measurement results of a loss elastic modulus of the cleaning blade.

FIG. 6 is a graph illustrating an example of measurement results of the loss elastic modulus E" of the cleaning blade 11.

As shown in FIG. 6, the loss elastic modulus E" of the cleaning blade 11 is a function whose variable is a temperatures T (° C.). In a temperature range of 0° C.≤T≤100° C., the loss elastic modulus E" of the cleaning blade 11 is approximated by an exponential function (i.e., an exponential approximation curve) represented by the following formula (4):

$$E''=\alpha\times e^{\beta T}(0^\circ\ \text{C.}\leq T\leq 100^\circ\ \text{C.}) \quad (4)$$

Coefficients α and β of the formula (4) are determined using, for example, a least-squares method. In this regard, the coefficient β will be referred to as an "inclination β".

The loss elastic modulus E" of the cleaning blade 11 in a certain temperature range is suitably approximated by the exponential function. The reason will be as follows. The cleaning blade which is a viscoelastic body is in a resin state at a low temperature (i.e., below a glass transition temperature Tg). In this state, most of an energy applied by oscillatory deformation is accumulated inside the viscoelastic body, and dissipation energy (i.e., heat dissipation) is small. In contrast, near the glass transition temperature Tg, rubber molecules start moving actively, and the dissipation energy becomes large. When the temperatures further rises, a unit of movement of rubber molecules becomes large, and movement of molecules expands to a whole body of a crosslinked mesh. In this state, elasticity becomes dominant, and the dissipation energy becomes small. The dissipation energy corresponds to the loss elastic modulus. A work per cycle required to cause oscillatory deformation of the viscoelastic body is expressed as $\pi\gamma^2E''$, where γ is a strain.

The dissipation energy in a rubber region (i.e., where the temperature is higher than or equal to the glass transition temperature Tg) decreases exponentially. This is because when the temperatures is higher than or equal to the glass transition temperature Tg, the unit of movement of rubber molecules becomes large, and expands to the whole body of the crosslinked mesh, so that the elasticity becomes dominant. Therefore, the loss elastic modulus also decreases exponentially with increase in temperature. For this reason, it is most suitable to exponentially approximate the loss elastic modulus in a certain temperature range.

A rate of change in actual loss elastic modulus differs depending on the temperature range. Therefore, for example, if the loss elastic modulus is linearly approximated in a certain temperature range under the assumption that the rate of change with temperature is constant throughout all temperature ranges, it is difficult to represent characteristics of a parameter (i.e., the loss elastic modulus) corresponding to dissipation energy of the cleaning blade. Therefore, using such a linear approximation, it is difficult to represent the characteristics of the loss elastic modulus whose changing rate differs depending on the temperature range.

<Relationship Between Loss Elastic Modulus E" and Stick-Slip Motion>

The loss elastic modulus E" is considered to have large influence on a stick-slip distance $L_0$, and a cycle (i.e., a oscillation cycle) of the stick-slip motion is considered to be determined by the loss elastic modulus E". Therefore, it is considered that the cleaning blade 11 with reduced temperature dependence and capable of suppressing the passing-through of the external additives can be obtained by defining, for example, the coefficient α and the inclination β of the exponential approximation curve based on the formula (4) of the loss elastic modulus E" of the cleaning blade 11. Next, a reason why the stick-slip motion (i.e., the stick-slip distance L) can be controlled by defining parameters (for example, the coefficient α and the inclination β in the formula (4)) of the approximation function (i.e., exponential approximation curve) of the loss elastic modulus E" will be described.

As shown in FIGS. 5A and 5B, an amount of displacement of the cleaning blade 11 following the movement of the surface of the photosensitive drum 4 is expressed as a stick-slip distance $L_0$. According to the Voigt model, the stick-slip distance $L_0$ is represented by the following formula (5):

$$L_0=\frac{\mu_s-\mu_k-\mu_\delta}{E}+\gamma\tau\ln\frac{\mu_s-\mu_k}{\mu_\delta} \quad (5)$$

In the formula (5), $\mu_s$ is a static friction coefficient and $\mu_k$ is a dynamic friction coefficient. $\mu_\delta$ is a friction coefficient corresponding to an increasing amount of a dynamic friction force when the dynamic friction force is balanced with the elastic force. E is an elastic modulus. ν is a circumferential speed of the photosensitive drum 4. τ is a relaxation time.

The loss elastic modulus E" is a viscous component, and is represented by the following formula (6):

$$E''=q\eta\omega \quad (6)$$

In the formula (6), ω is a frequency. q is a shape factor in a dynamic viscoelasticity measurement, and is a ratio of a length to a cross sectional area of a rubber upon measurement. η is a dynamic viscosity coefficient. The loss elastic modulus E" is a viscous component, and is a function of the dynamic viscosity coefficient.

The relaxation time τ is represented by the following formula (7):

$$\tau=\frac{\eta}{E} \quad (7)$$

In the formula (7), η is a viscosity coefficient, and E is an elastic modulus.

The formula (7) is a ratio of the viscosity coefficient to the elastic modulus. There are many cases where the cleaning blade 11 is used in a temperature range higher than or equal to the glass transition temperature Tg (i.e., a glass transition point) within a temperature range in which the image forming apparatus 100 is used. In a temperature range lower than or equal to the glass transition temperature Tg, the micro-Brownian motion of polymer chains is frozen, and molecular chains are bonded together by interactions such as van der Waals' force. That is, rubber elasticity disappears is the temperature range lower than or equal to the glass transition temperature Tg. Therefore, in order to utilize rubber-elastic characteristics of the cleaning blade 11, the image forming apparatus 100 is used in the temperature range higher than the glass transition temperature Tg, i.e., a rubber flat region. The rubber flat region is a temperature range in which the elastic modulus does not change depending on temperature. Therefore, the elastic modulus E" is constant, and the relaxation time τ is a function of the viscosity coefficient n.

As described above, it is understood that the loss elastic modulus E" (which is the function of the dynamic viscosity coefficient) is a parameter determining the stick-slip distance $L_0$. Therefore, it becomes possible to control the stick-slip motion (i.e., the stick-slip distance $L_0$) by defining the coefficient α and the inclination β (the formula (4)) of the approximation function (i.e., the exponential approximation curve) of the loss elastic modulus E", which are parameters of the temperature dependence of the loss elastic modulus E" of the cleaning blade 11.

<Printing Tests>

A plurality of cleaning blades 11 having different characteristics are manufactured. Using these cleaning blades 11, printing tests are performed to examine a relationship between the parameters (i.e., the coefficient $\alpha$ and the inclination $\beta$ of the exponential approximation curve based on the formula (4)) of the loss elastic modulus E" of the cleaning blade 11 in the temperature range from 0 to 100° C. and degree of adhesion of the external additives on the surface of the charging roller 5.

The cleaning blade 11 having a large coefficient $\alpha$ can be manufactured by, for example, increasing an amount of 1,4-butanediol as the hardening agent. Further, for example, when ethylene adipate is used as a material of the cleaning blade 11, the loss elastic modulus E" shows a steep inclination $\beta$ with increase in temperature.

In the printing test, the manufactured cleaning blade 11 is mounted to the image forming apparatus 100, and a continuous printing is performed. After leaving the image forming apparatus 100 in an environment of a specific temperature and a specific humidity for 12 hours, the continuous printing is performed in the same environment. A printing pattern having a duty ratio of 20% is continuously printed on 72,000 faces on both sides of 36,000 printing sheets of a letter size. For each kind of the cleaning blades 11, the printing tests are performed in a test environment 1 (i.e., a high temperature and high humidity environment), a test environment 2 (i.e., a normal temperature and normal humidity environment) and a test environment 3 (i.e., a low temperature and low humidity environment). In the test environment 1, the temperature is 27° C. and the relative humidity is 80%. In the test environment 2, the temperature is 22° C. and the relative humidity is 55%. In the test environment 3, the temperature is 10° C. and the relative humidity is 20%.

A "monochrome printer B731" manufactured by Oki Data Corporation is used as the image forming apparatus 100. The monochrome printer used in the printing tests is the same as the image forming apparatus 100 to which only one image forming unit (for example, the image forming unit 1K) among four image forming units 1K, 1Y, 1M and 1C is mounted.

The cleaning blade 11 used in the printing tests has the free end length L of 7.9 mm, and the thickness of 2 mm.

In the printing tests, the cleaning angle $\theta_1$ (FIG. 3A) of the cleaning blade 11 with respect to the photosensitive drum 4 is set to 10 degrees, and the linear pressure W (i.e., a pressing force) is set to 12 gf/an. The charge voltage is set to −950V, the developing voltage is set to −200V, the supply voltage is set to −300V, and the transfer voltage is set to +2000V. In this regard, these voltages are applied in the printing tests. Voltages applied to the respective elements in a normal printing operation of the image forming apparatus 100 are not limited to the above described voltages.

Figures 7A, 7B:
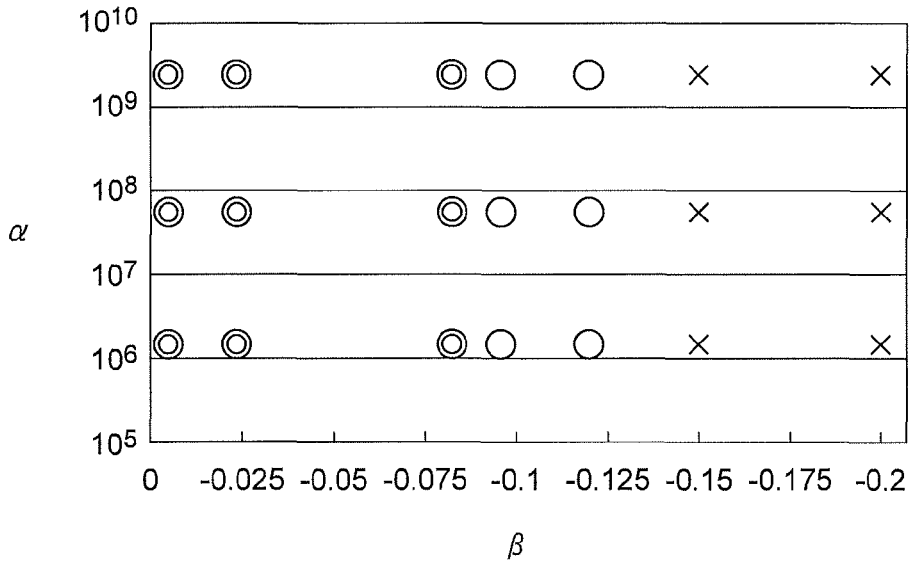
FIG. 7A is a table illustrating a relationship between a coefficient and an inclination of an exponential approximation curve of the loss elastic modulus of the cleaning blade and evaluation results of printing tests.
FIG. 7B is a graph illustrating the relationship between the coefficient and the inclination and the evaluation results.

FIG. 7A is a graph illustrating a relationship between the coefficient $\alpha$ and the inclination $\beta$ of the exponential approximation curve of the loss elastic modulus E" of the cleaning blade 11 used in the printing tests and evaluation results of the printing tests. FIG. 7B is a graph illustrating the relationship between the coefficient $\alpha$ and the inclination $\beta$ and the evaluation results of the printing tests shown in FIG. 7A.

Evaluation of the printing tests is performed after the continuous printing is performed on the 72,000 faces of the printing sheets. In the evaluation of the printing tests, the surface of the charging roller 5 of the image forming unit 1 of the printer is visually observed, and degree of adhesion of the external additives on the surface of the charging roller 5 is checked. If the adhesion of the external additives on the surface of the charging roller 5 is not found (observed), the evaluation result is excellent (◎: double circle). If the adhesion of the external additives on the surface of the charging roller 5 is found, but does not appear on a printed image, the evaluation result is good (○: circle). If the adhesion of the external additives on the surface of the charging roller 5 is found, and appears on the printed image, the evaluation result is poor (X). The coefficient $\alpha$ and the inclination $\beta$ of the exponential approximation curve of the loss elastic modulus E" of the cleaning blade 11 used in the printing tests are calculated by the least-squares method using the formula (4).

As shown in FIGS. 7A and 7B, when the coefficient $\alpha$ and the inclination $\beta$ of the exponential approximation curve of the loss elastic modulus E" based on the formula (4) in the temperature range from 0 to 100° C. satisfy:

$$1.36\times10^3\leq\alpha\leq2.24\times10^9, \text{ and}$$

$$-0.12\leq\beta\leq-0.005,$$

the passing-through of the external additives through between the cleaning blade 11 and the surface of the photosensitive drum 4 is suppressed to an insignificant level (i.e., a level causing no practical problem). That is, printing defects due to adhesion of the external additives are suppressed, and excellent printing quality (i.e., image quality) is obtained.

More preferably, as shown in FIGS. 7A and 7B, when the coefficient $\alpha$ and the inclination $\beta$ of the exponential approximation curve of the loss elastic modulus E" based on the formula (4) in the temperature range from 0 to 100° C. satisfy:

$$1.36\times10^3\leq\alpha\leq2.24\times10^9, \text{ and}$$

$$-0.083\leq\beta\leq-0.005,$$

the passing-through of the external additives through between the cleaning blade 11 and the surface of the photosensitive drum 4 is suppressed to an unobservable level (i.e., a level at which the external additives are not visually observed). That is, printing defects due to adhesion of the external additives are further suppressed, and more excellent printing quality (i.e., image quality) is obtained.

In this regard, although the loss elastic modulus E" of the cleaning blade 11 can be changed by adjusting the kind of polyester or the amount of the hardening agent, the adjustment of the loss elastic modulus E" has a limit. For example, it is difficult to manufacture the cleaning blade 11 satisfying $\alpha<1.36\times10^3$. Therefore, in Embodiment 1, the cleaning blade 11 satisfying the relationship $1.36\times10^3\leq\alpha\leq2.24\times10^9$ is used in the printing tests and evaluations.

Further, the above described ranges of the coefficient $\alpha$ and the inclination $\beta$ are not limited to those of the loss elastic modulus E" of a whole body of the cleaning blade 11. That is, when the coefficient $\alpha$ and the inclination $\beta$ of the exponential approximation curve of the loss elastic modulus E" of the material of the corner portion 110 (i.e., the contact portion) of the cleaning blade 11 based on the formula (4) in the temperature range from 0 to 100° C. satisfy $1.36\times10^3\leq\alpha\leq2.24\times10^9$ and $-0.12\leq\beta\leq-0.005$ (more preferably, $-0.083\leq\beta\leq-0.005$), the passing-through of the external additives through between the cleaning blade 11 and the surface of the photosensitive drum 4 can be reduced.

Advantages of Embodiment 1

As described above, according to Embodiment 1, the coefficient α and the inclination β of the exponential approximation curve (i.e., the formula (4)) in the temperature range from 0 to 100° C. calculated based on the loss elastic modulus E" of the material of the cleaning blade 11 measured at the frequency of 10 Hz and the temperature rising rate of 2° C./min satisfy:

$$1.36\times10^3\leq\alpha\leq2.24\times10^9, \text{ and}$$

$$-0.12\leq\beta\leq-0.005.$$

With such a configuration, the image forming apparatus 100 using the cleaning blade 11 can form an image with excellent quality.

More preferably, the coefficient α and the inclination R of the exponential approximation curve (i.e., the formula (4)) in the temperature range from 0 to 100° C. calculated based on the loss elastic modulus E" of the material of the cleaning blade 11 measured at the frequency of 10 Hz and the temperature rising rate of 2° C./min satisfy:

$$1.36\times10^3\leq\alpha\leq2.24\times10^9, \text{ and}$$

$$-0.083\leq\beta\leq-0.005.$$

With such a configuration, the image forming apparatus 100 using the cleaning blade 11 can form an image with more excellent quality.

Embodiment 2

In Embodiment 2, a function (i.e., an approximation function) used to determine the loss elastic modulus E" of the cleaning blade 11 is different from the function (i.e., the formula (4)) in Embodiment 1. Other features of Embodiment 2 are the same as those of Embodiment 1. Elements of Embodiment 2 identical to or corresponding to the elements of the image forming apparatus 100 of Embodiment 1 are assigned with the same reference numerals.

In Embodiment 1, the loss elastic modulus E" is measured at the frequency of 10 Hz and the temperature rising rate of 2° C./min, and the formula (4) is used as the approximation function based on the measured loss elastic modulus E". In Embodiment 2, the following formula (8) is used as the approximation function determined on the same condition as in Embodiment 1. The formula (8) is an exponential function in which a temperatures T (° C.) is a variable and α, β and γ are coefficients. In Embodiment 2, ranges of coefficients α, β and γ in the formula (8) are defined so as to enhance image quality. Hereinafter, coefficients β and γ will be respectively referred to as an "inclination β" and an "intercept γ".

$$E''=\alpha\times e^{\beta T}+\gamma(0°\text{ C.}\leq T\leq100°\text{ C.}) \quad (8)$$

As described in Embodiment 1, the loss elastic modulus E" is considered to have large influence on the stick-slip distance $L_0$, and the cycle (i.e., oscillation cycle) of the stick-slip motion is considered to be determined by the loss elastic modulus E". Therefore, the cleaning blade 11 with reduced temperature dependence and capable of suppressing the passing-through of the external additives can be obtained by defining, for example, the coefficient α, the inclination β and the intercept γ of the exponential approximation curve based on the formula (8) of the loss elastic modulus E" of the cleaning blade 11. Particularly, it is considered that the passing-through of the external additives in the high temperature and high humidity environment can be suppressed by specifying the intercept γ of the exponential approximation curve based on the formula (8).

<Printing Tests>

A plurality of cleaning blades 11 having different characteristics are manufactured. Using these cleaning blades 11, printing tests are performed to examine a relationship between the parameters (i.e., the coefficient α, the inclination β and the intercept γ of the exponential approximation curve based on the formula (8)) of the loss elastic modulus E" of the cleaning blade 11 and in the temperature range from 0 to 100° C. and degree of adhesion of the external additives on the surface of the charging roller 5.

The cleaning blade 11 having a large intercept γ can be manufactured by, for example, using butylene adipate as the material of the cleaning blade 11.

The manufacturing method of the cleaning blade 11, and the method and conditions of the measurement of the loss elastic modulus E" of the material of the cleaning blade 11 are the same as those described in Embodiment 1.

The method and conditions of the printing tests are the same as those described in Embodiment 1.

Figures 8A, 8B:
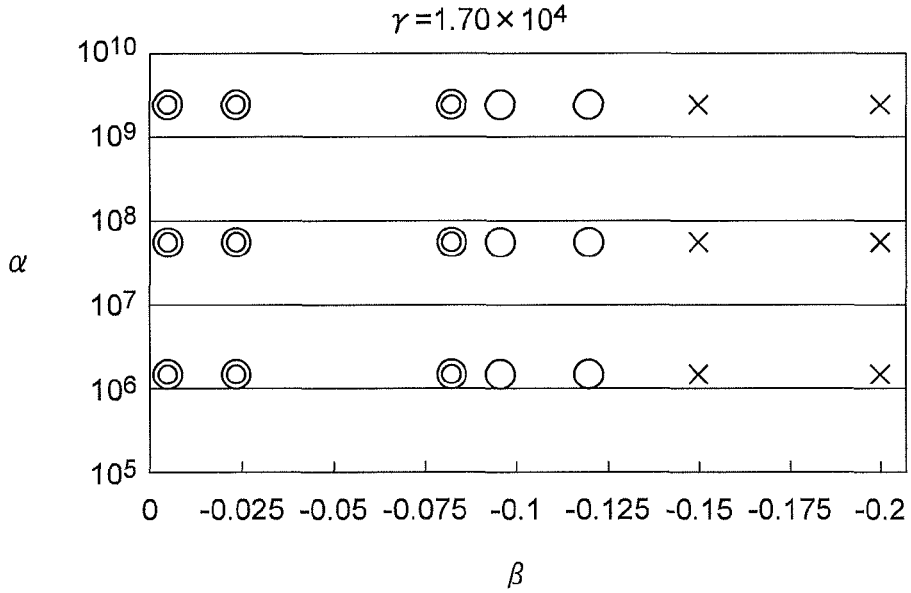
FIG. 8A is a table illustrating a relationship between a coefficient, an inclination and an intercept of an exponential approximation curve of a loss elastic modulus of a cleaning blade and evaluation results of printing tests.
FIG. 8B is a graph illustrating the relationship between the coefficients and the inclinations and the evaluation results when the intercept takes a specified value.

FIG. 8A is a graph illustrating a relationship between the coefficient α, the inclination R and the intercept γ of the exponential approximation curve of the loss elastic modulus E" of the cleaning blade 11 used in the printing tests and evaluation results of the printing tests. FIG. 8B is a graph illustrating the relationship between the coefficient α and the inclination β and the evaluation results of the printing tests shown in FIG. 8A when the intercept γ is a specified value, i.e., $1.70\times10^4$.

Figures 9A, 9B:
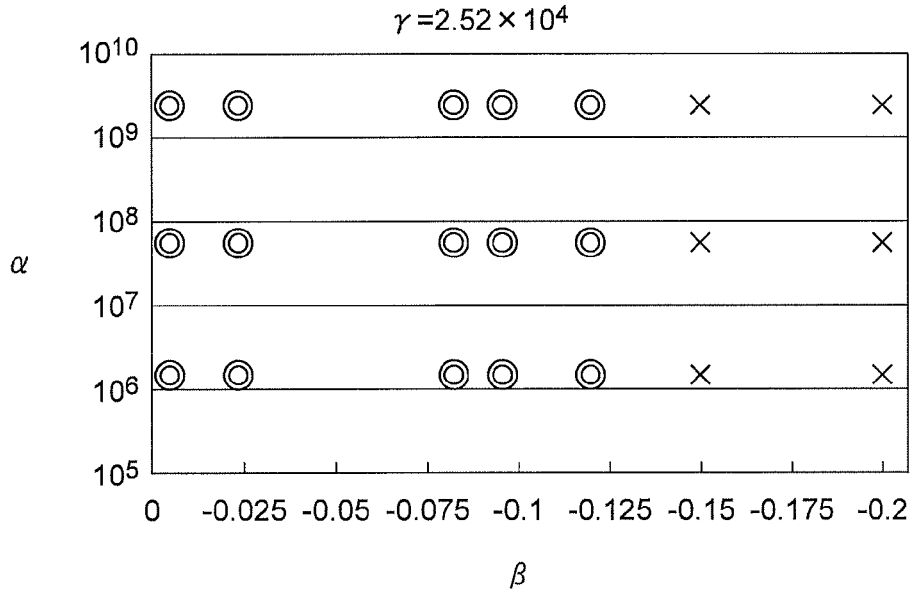
FIG. 9A is a table illustrating a relationship between the coefficient, the inclination and the intercept of the exponential approximation curve of the loss elastic modulus of the cleaning blade and the evaluation results of printing tests.
FIG. 9B is a graph illustrating the relationship between the coefficients and the inclinations and the evaluation results when the intercept takes another specified value.

FIG. 9A is a graph illustrating a relationship between the coefficient α, the inclination β and the intercept γ of the exponential approximation curve of the loss elastic modulus E" of the cleaning blade 11 used in the printing tests and evaluation results of the printing tests. FIG. 9B is a graph illustrating the relationship between the coefficient α and the inclination β and the evaluation results of the printing tests shown in FIG. 9A when the intercept γ is another specified value, i.e., $2.52\times10^4$.

Figures 10A, 10B:
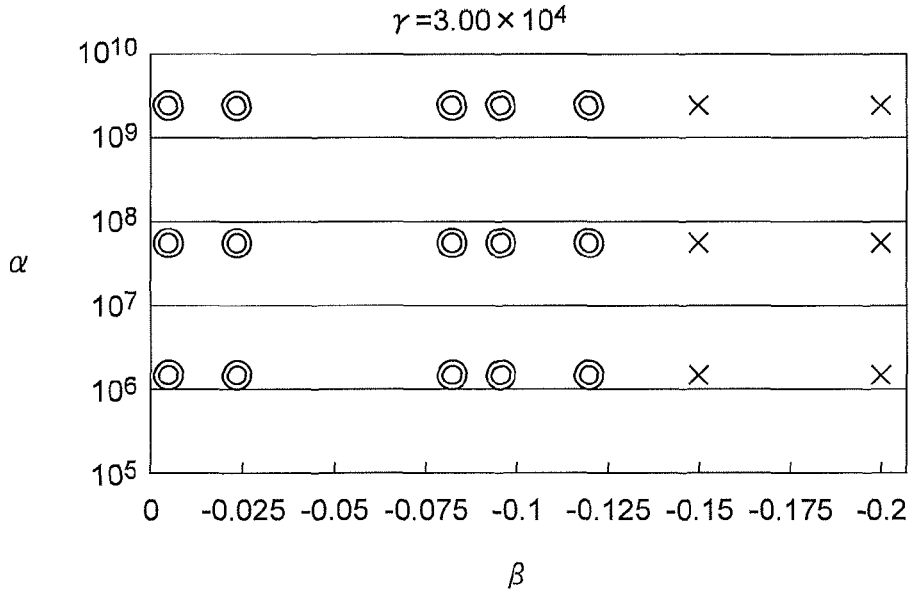
FIG. 10A is a table illustrating a relationship between the coefficient, the inclination and the intercept of the exponential approximation curve of the loss elastic modulus of the cleaning blade and the evaluation results of printing tests.
FIG. 10B is a graph illustrating the relationship between the coefficients and the inclinations and the evaluation results when the intercept takes still another specified value.

FIG. 10A is a graph illustrating a relationship between the coefficient α, the inclination β and the intercept γ of the exponential approximation curve of the loss elastic modulus E" of the cleaning blade 11 used in the printing tests and evaluation results of the printing tests. FIG. 10B is a graph illustrating the relationship between the coefficient α and the inclination β and the evaluation results of the printing tests shown in FIG. 10A when the intercept γ is still another specified value, i.e., $3.00\times10^4$.

Figures 11A, 11B:
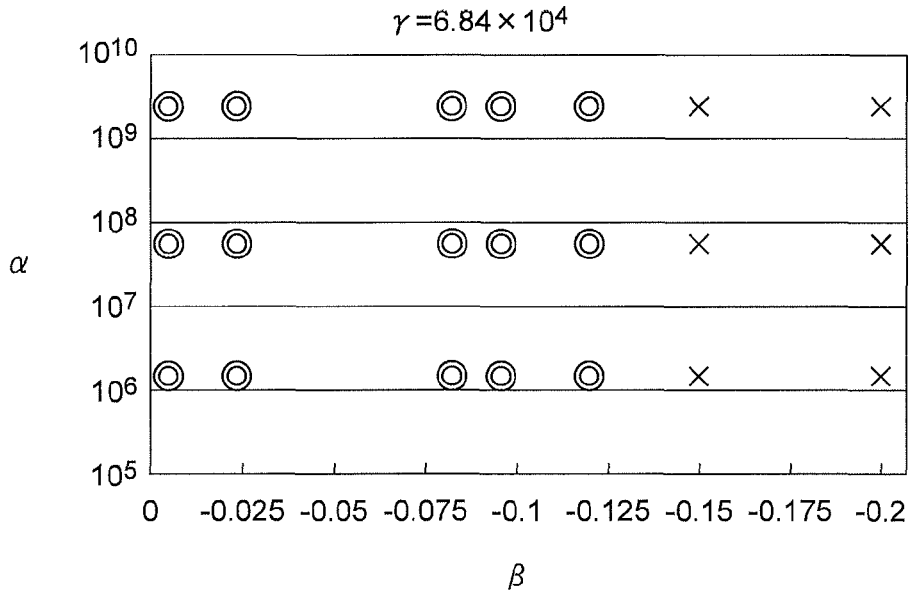
FIG. 11A is a table illustrating a relationship between the coefficient, the inclination and the intercept of the exponential approximation curve of the loss elastic modulus of the cleaning blade and the evaluation results of printing tests.
FIG. 11B is a graph illustrating the relationship between the coefficients and the inclinations and the evaluation results when the intercept takes yet another specified value.

FIG. 11A is a graph illustrating a relationship between the coefficient α, the inclination β and the intercept γ of the exponential approximation curve of the loss elastic modulus E" of the cleaning blade 11 used in the printing tests and evaluation results of the printing tests. FIG. 11B is a graph illustrating the relationship between the coefficient α and the inclination β and the evaluation results of the printing tests shown in FIG. 11A when the intercept γ is yet another specified value, i.e., $6.84\times10^4$.

Figures 12A, 12B:
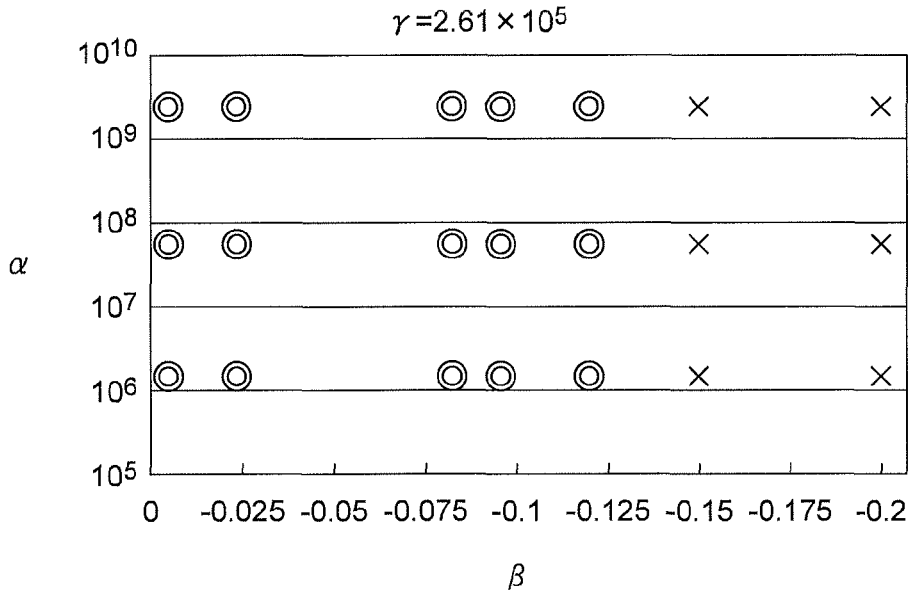
FIG. 12A is table illustrating a relationship between the coefficient, the inclination and the intercept of the exponential approximation curve of the loss elastic modulus of the cleaning blade and the evaluation results of printing tests.
FIG. 12B is a graph illustrating the relationship between the coefficients and the inclinations and the evaluation results when the intercept takes further specified value.

FIG. 12A is a graph illustrating a relationship between the coefficient α, the inclination β and the intercept γ of the exponential approximation curve of the loss elastic modulus E" of the cleaning blade 11 used in the printing tests and evaluation results of the printing tests. FIG. 12B is a graph illustrating the relationship between the coefficient α and the inclination β and the evaluation results of the printing tests shown in FIG. 12A when the intercept γ is further specified value, i.e., $2.61\times10^5$.

The coefficient α, the inclination β and the intercept γ of the exponential approximation curve of the loss elastic modulus E" of the cleaning blade 11 used in the printing tests are calculated by the least-squares method using the formula (8).

As shown in FIGS. 8A and 8B through FIGS. 12A and 12B, when the coefficient α, the inclination β and the intercept γ of the exponential approximation curve of the loss elastic modulus E" based on the formula (8) in the temperature range from 0 to 100° C. satisfy:

$$1.36\times10^3\leq\alpha\leq2.24\times10^9,$$

$$-0.12\leq\beta\leq-0.005, \text{ and}$$

$$1.70\times10^4\leq\gamma\leq2.61\times10^5$$

the passing-through of the external additives through between the cleaning blade 11 and the surface of the photosensitive drum 4 is suppressed to an insignificant level (i.e., a level causing no practical problem). That is, printing defects due to adhesion of the external additives are suppressed, and excellent printing quality is obtained.

More preferably, as shown in FIGS. 8A and 8B through FIGS. 12A and 12B, when the coefficient α, the inclination β and the intercept γ of the exponential approximation curve of the loss elastic modulus E" based on the formula (8) in the temperature range from 0 to 100° C. satisfy:

$$1.36\times10^3\leq\alpha\leq2.24\times10^9,$$

$$-0.12\leq\beta\leq-0.005, \text{ and}$$

$$2.52\times10^4\leq\gamma\leq2.61\times10^5,$$

the passing-through of the external additives through between the cleaning blade 11 and the surface of the photosensitive drum 4 is suppressed to an unobservable level (i.e., a level at which the external additives are not visually observed). That is, printing defects due to adhesion of the external additives are further suppressed, and more excellent printing quality is obtained.

In this regard, although the loss elastic modulus E" of the cleaning blade 11 can be changed by adjusting the kind of polyester or the amount of the hardening agent, the adjustment of the loss elastic modulus E" has a limit. For example, it is difficult to manufacture the cleaning blade 11 satisfying $\gamma>2.61\times10^5$. Therefore, in Embodiment 2, the cleaning blade 11 satisfying the relationship $1.70\times10^4\leq\gamma\leq2.61\times10^5$ is used in the printing tests and evaluations.

Further, the above described ranges of the coefficient α, the inclination β and the intercept γ are not limited to those of the loss elastic modulus E" of a whole body of the cleaning blade 11. That is, when the coefficient α, the inclination β and the intercept γ of the exponential approximation curve of the loss elastic modulus E" of the material of the corner portion 110 (i.e., the contact portion) of the cleaning blade 11 based on the formula (8) in the temperature range from 0 to 100° C. satisfy $1.36\times10^3\leq\alpha\leq2.24\times10^9$, $-0.12\leq\beta\leq-0.005$ and $1.70\times10^4\leq\gamma\leq2.61\times10^5$ (more preferably, $2.52\times10^4\leq\gamma\leq2.61\times10^5$), the passing-through of the external additives through between the cleaning blade 11 and the surface of the photosensitive drum 4 can be reduced.

Advantages of Embodiment 2

As described above, according to Embodiment 2, the coefficient α, the inclination β and the intercept γ of the exponential approximation curve (i.e., the formula (8)) in the temperature range from 0 to 100° C. calculated based on the loss elastic modulus E" of the material of the cleaning blade 11 measured at the frequency of 10 Hz and the temperature rising rate of 2° C./min satisfy:

$$1.36\times10^3\leq\alpha\leq2.24\times10^9,$$

$$-0.12\leq\beta\leq-0.005, \text{ and}$$

$$1.70\times10^4\leq\gamma\leq2.61\times10^5.$$

With such a configuration, the image forming apparatus 100 using the cleaning blade 11 can form an image with excellent quality.

More preferably, the image forming apparatus 100, and when the coefficient α, the inclination β and the intercept γ of the exponential approximation curve (i.e., the formula (8)) in the temperature range from 0 to 100° C. calculated based on the loss elastic modulus E" of the material of the cleaning blade 11 measured at the frequency of 10 Hz and the temperature rising rate of 2° C./min satisfy:

$$1.36\times10^3\leq\alpha\leq2.24\times10^9,$$

$$-0.12\leq\beta\leq-0.005, \text{ and}$$

$$2.52\times10^4\leq\gamma\leq2.61\times10^5.$$

With such a configuration, the image forming apparatus 100 using the cleaning blade 11 can form an image with more excellent quality.

In the above described printing tests of Embodiments 1 and 2, the charge voltage is set to −950V, the developing voltage is set to −200V, the supply voltage is set to −300V and the transfer voltage is set to +2000V. However, the same results can be obtained when the charge voltage is in a range from −900V to −1200V, the developing voltage is in a range from −100V to −300V, the supply voltage is in a range from −100V to −400V, and the transfer voltage is in a range from +1500V to +5000V.

In Embodiments 1 and 2, description has been made of the printer as an example of the image forming apparatus 100. However, the image forming apparatus 100 is not limited to the printer. For example, the image forming apparatus 100 may be an apparatus such as a facsimile machine, a copier, an MFT (Multi-Function Peripheral) and the like configured to form an image on a medium using electrophotography.

While the preferred embodiments of the present invention have been illustrated in detail, it should be apparent that modifications and improvements may be made to the invention without departing from the spirit and scope of the invention as described in the following claims.

What is claimed is:

1. An image forming apparatus comprising:

an image bearing body; and a cleaning blade having a contact portion contacting a surface of the image bearing body to remove a developer remaining on the surface of the image bearing body when the image bearing body rotates, wherein, using coefficients α [Pa], β [1/° C.], and γ [Pa] and a temperature T [° C.], a loss elastic modulus E" [Pa] of the cleaning blade is represented by:

$$E''=\alpha\times e^{\beta T}+\gamma;$$

$$1.36\times10^3\leq\alpha\leq2.24\times10^9;$$

$$-0.12\leq\beta\leq-0.005;$$

$$1.70\times10^4\leq\gamma\leq2.61\times10^5; \text{ and}$$

$$0° \text{ C.}\leq T\leq100° \text{ C.},$$

wherein an angle between a tangential line at a deformation starting point of the cleaning blade and a tangential line at a point where the contact portion contacts the surface of the image bearing body is in a range from 10 to 15 degrees, wherein the contact portion of the cleaning blade is pressed against the surface of the image bearing body with a linear pressure in a range from 12 gf/cm to 24 gf/cm.

2. The image forming apparatus according to claim 1, wherein the coefficient γ satisfies:

$$2.52\times10^4\leq\gamma\leq2.61\times10^5.$$

3. The image forming apparatus according to claim 1, wherein the coefficients α, β, and γ are determined by calculation based on the loss elastic modulus E" of the cleaning blade measured at a frequency of 10 Hz and a temperature rising rate of 2° C./min in a temperature range from 0 to 100° C.

4. The image forming apparatus according to claim 1, wherein the contact portion is formed of urethane rubber.

5. The image forming apparatus according to claim 1, wherein the loss elastic modulus E" of the cleaning blade is a loss elastic modulus E" of the contact portion.

6. The image forming apparatus according to claim 1, wherein the loss elastic modulus E" of the cleaning blade is measured by applying a force of 50 mN to the cleaning blade.

7. The image forming apparatus according to claim 1, wherein the loss elastic modulus E" of the cleaning blade is measured using a viscoelasticity measuring method by heating the cleaning blade at a temperature rising rate of 2° C./min and applying a tension of 50 mN at a frequency of 10 Hz to the cleaning blade.

8. The cleaning blade image forming apparatus according to claim 1, wherein the loss elastic modulus E" of the cleaning blade is measured by applying a tension Ft expressed as follows:

$$F_t=F_{base}+F_{0gain}\times F_0$$

where $F_{base}$ is a minimum tension of 50 mN, $F_{0gain}$ is a gain of 1.2, and $F_0$ is a force amplitude of 50 mN.

9. The image forming apparatus according to claim 1, wherein the contact portion of the cleaning blade contains trimethylolpropane or 1, 4-butanediol as a hardening agent.

10. The image forming apparatus according to claim 1, wherein the contact portion of the cleaning blade contains polyester.

11. The image forming apparatus according to claim 1, wherein the contact portion of the cleaning blade contains ethylene adipate, butylene adipate, or hexamethylene adipate.

12. The image forming apparatus according to claim 1, wherein the surface of the image bearing body contains at least one of polyvinyl butyral resin and polyvinyl formal resin.

13. The image forming apparatus according to claim 1, wherein the developer is a nonmagnetic single component developer including mother particles containing a resin and a coloring agent, and external additives;

wherein a mean particle diameter of the external additives is in a range from 5 to 400 nm; and wherein an amount of the external additives with respect to 100 weight parts of the mother particles is in a range from 0.5 to 8.0 weight parts.

14. The image forming apparatus according to claim 1, wherein the developer includes mother particles and external additives;

wherein an amount of the external additives with respect to 100 weight parts of the mother particles is in a range from 1.5 to 6.0 weight parts.

15. The image forming apparatus according to claim 14, wherein the amount of the external additives with respect to 100 weight parts of the mother particles is in a range from 1.5 to 5.0 weight parts.

16. The image forming apparatus according to claim 14, wherein the external additives include organic fine particles.

17. The image forming apparatus according to claim 14, wherein the external additives include melamine.

18. The image forming apparatus according to claim 14, wherein the external additives include organic fine particles, melamine and silica.

19. The image forming apparatus according to claim 1, further comprising:

a charging member that charges the surface of the image bearing body, the charging member being applied with a charge voltage in a range from −900V to −1200V;

a developer bearing body that develops a latent image on the image bearing body to form a developer image, the developer bearing body being applied with a developing voltage in a range from −100V to −300V;

a supply member that supplies the developer to the developer bearing body, the supply member being applied with a supply voltage in a range from −100V to −400V; and a transfer member that transfers the developer image from the image bearing body to a medium, the transfer member being applied with a transfer voltage in a range from +1500V to +5000V.

20. The image forming apparatus according to claim 1, wherein the contact portion of the cleaning blade is deformed to form a blade nip and repeats a stick-slip motion in response to movement of the image bearing body.

* * * * *